US011426857B2

(12) United States Patent
Weinschenk

(10) Patent No.: US 11,426,857 B2
(45) Date of Patent: Aug. 30, 2022

(54) TRUSS JIGGING SYSTEM AND METHOD

(71) Applicant: Steven R. Weinschenk, Rochester, MN (US)

(72) Inventor: Steven R. Weinschenk, Rochester, MN (US)

(73) Assignee: Wein Holding, LLC, Rochester, MN (US)

( * ) Notice: Subject to any disclaimer, the term of this patent is extended or adjusted under 35 U.S.C. 154(b) by 222 days.

(21) Appl. No.: 16/671,982

(22) Filed: Nov. 1, 2019

(65) Prior Publication Data

US 2020/0139533 A1 May 7, 2020

Related U.S. Application Data

(60) Provisional application No. 62/754,578, filed on Nov. 1, 2018.

(51) Int. Cl.
*B25H 1/10* (2006.01)

(52) U.S. Cl.
CPC ..... *B25H 1/10* (2013.01)

(58) Field of Classification Search
CPC ..... Y10S 269/91; Y10S 269/909; Y10T 29/5397; Y10T 29/53961; B23Q 3/102; B23Q 3/06; B23Q 5/38; B23Q 5/385; B27F 7/155; B25H 1/10
See application file for complete search history.

(56) References Cited

U.S. PATENT DOCUMENTS 5,854,747 A * 12/1998 Fairlie ..... B25B 11/00 700/114
8,109,493 B2 2/2012 Koskovich et al.
9,821,440 B1 11/2017 Fredrickson et al.
(Continued)

OTHER PUBLICATIONS

AVX, "High Capacitance Cylindrical SuperCapacitors", "download from: https://www.mouser.com/datasheet/2/40/AVX-SCC-1018831.pdf", No date provided.
(Continued)

*Primary Examiner* — Tyrone V Hall, Jr.
*Assistant Examiner* — Abbie E Quann
(74) *Attorney, Agent, or Firm* — Charles A. Lemaire; Jonathan M. Rixen; Lemaire Patent Law Firm, P.L.L.C.

(57) ABSTRACT

A truss-jig-positioning system that includes a truss-assembly table having a support plane, a plurality of slots in the support plane, and a plurality of puck assemblies automatically movable along the slots. Each puck is self-powered and self-locks at selected locations. A controller controls the pucks. Images of the truss-assembly table and pucks allow the controller to locate pucks, and transmit location-correction information as needed to move pucks to desired locations for building various trusses, wall assemblies, etc. Pucks are self-powered, self-moving, motorized jigging members. Each operates from controller commands to unlock from one location, move along their slot and lock to a new location. Optionally location-measuring (machine-vision) subsystem(s) communicate wirelessly with the pucks to readjust positions and re-lock at the adjusted position. Optionally, the jigging pucks can automatically move along slots to connect to a recharging station to self-recharge on-puck batteries or supercapacitors.

20 Claims, 13 Drawing Sheets

(56) References Cited

U.S. PATENT DOCUMENTS

| | | | | |
|---|---|---|---|---|
| 10,207,421 | B1 | 2/2019 | Weinschenk | |
| 10,210,607 | B1 * | 2/2019 | Weinschenk | H04N 9/3147 |
| 10,239,225 | B1 | 3/2019 | Weinschenk | |
| 10,460,880 | B2 | 10/2019 | Snyder | |
| 10,487,505 | B2 * | 11/2019 | Joseph | E04C 3/17 |

OTHER PUBLICATIONS

Taiyo Yuden Co., Ltd., "Handling Precautions of Cylinder Type Lithium Ion Capacitors", "download from: http://www.mouser.com/datasheet/2/396/taiyoyuden_capacitor03_e-1488112.pdf", 2016.

* cited by examiner

*FIG. 1A1*
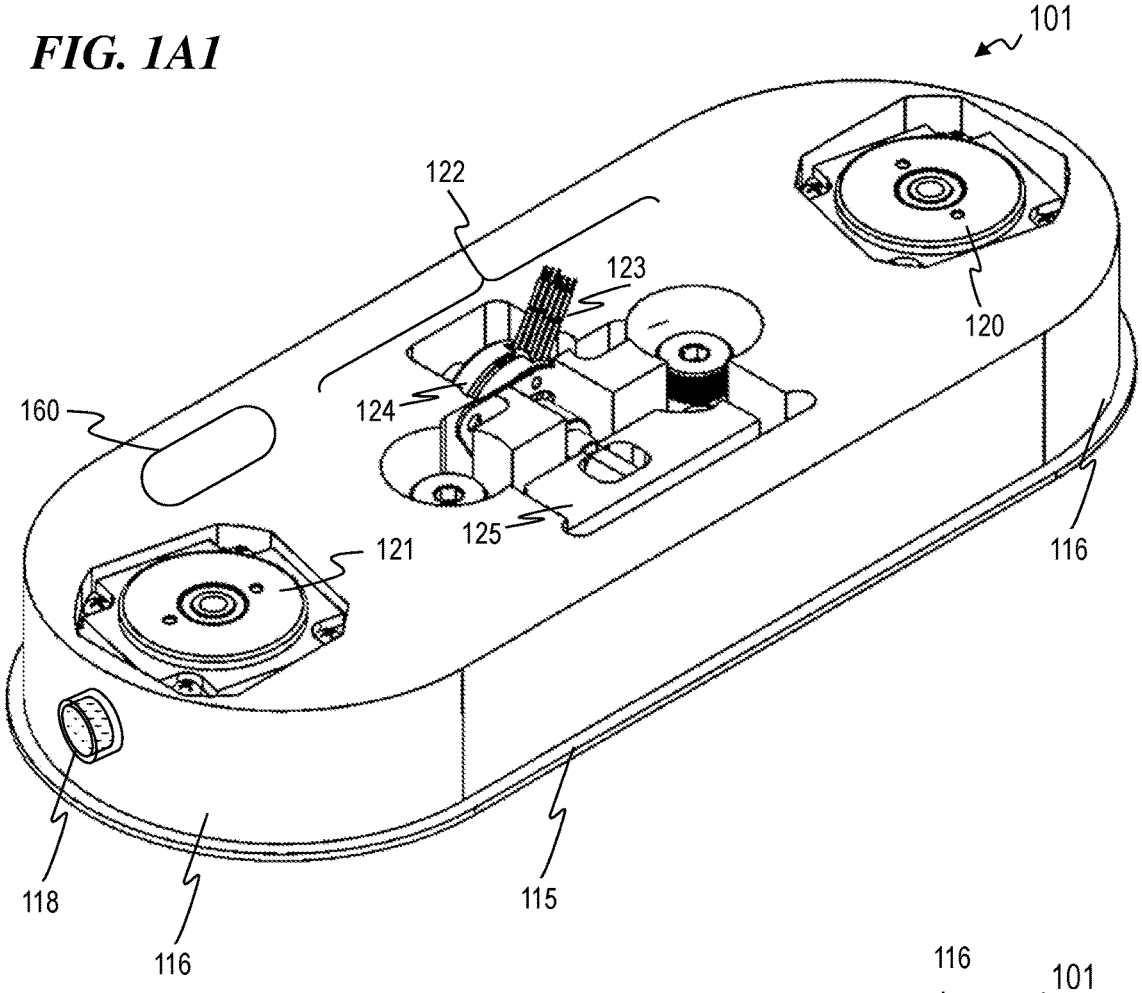
*FIG. 1A2*
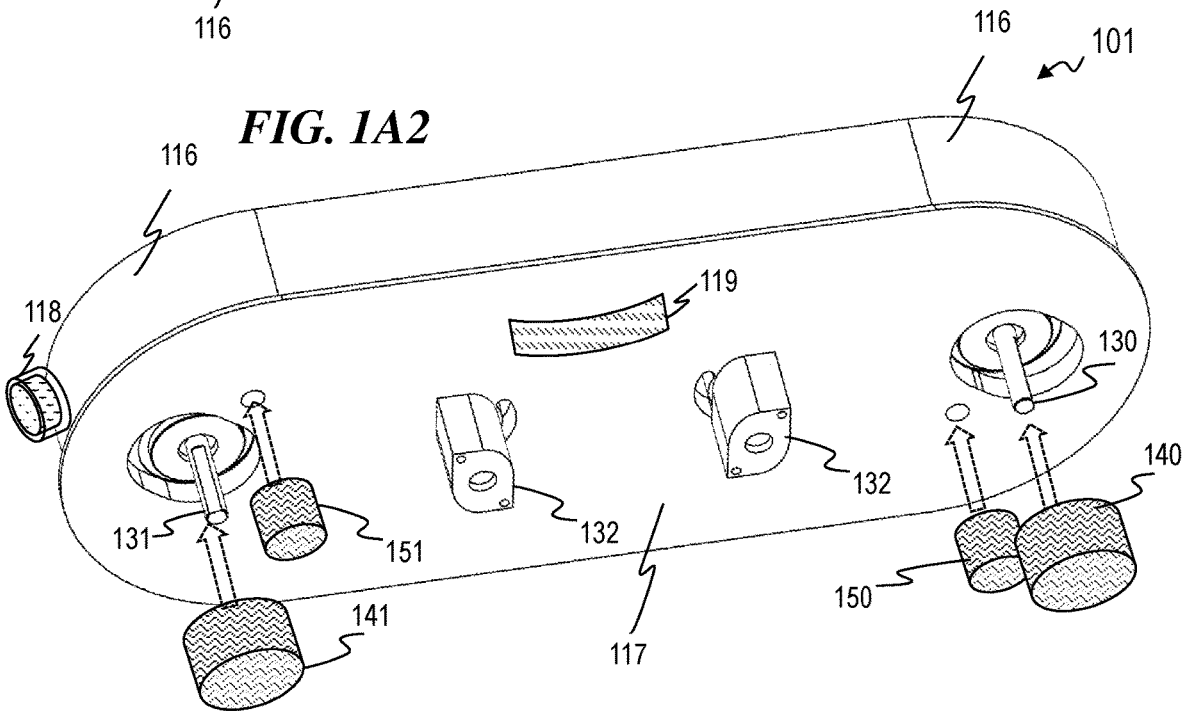

*FIG. 1A3*
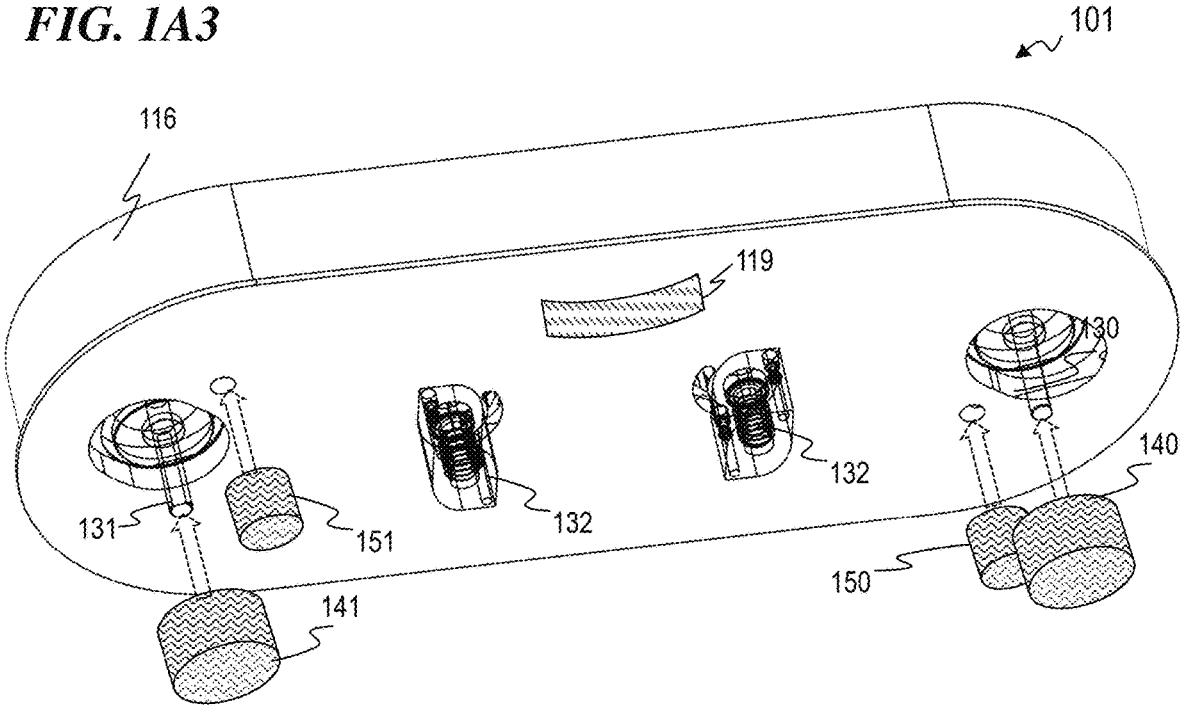
*FIG. 1A4*
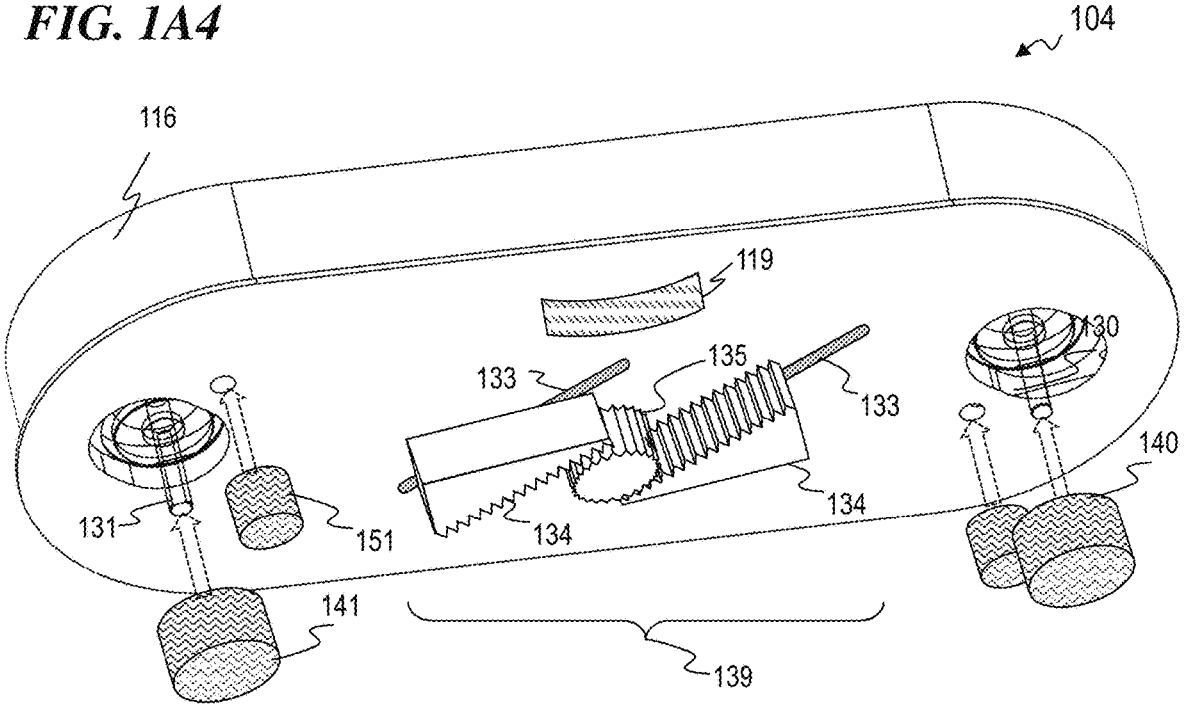

TRUSS JIGGING SYSTEM AND METHOD

CROSS-REFERENCE TO RELATED APPLICATIONS

This application claims priority benefit, under 35 U.S.C. § 119(e), of U.S. Provisional Patent Application No. 62/754,578, filed Nov. 1, 2018 by Steven R. Weinschenk, titled "TRUSS JIGGING SYSTEM AND METHOD," which is incorporated herein by reference in its entirety.

This application is related to:

U.S. patent application Ser. No. 15/093,732 filed Apr. 7, 2016 by Steven R. Weinschenk, et al., titled "DIGITAL PROJECTION SYSTEM AND METHOD FOR WORK-PIECE ASSEMBLY" (now U.S. Pat. No. 10,210,607);

U.S. patent application Ser. No. 15/408,369 filed Jan. 17, 2017 by Steven R. Weinschenk, titled "AUTOMATED SYSTEM AND METHOD TO ENHANCE SAFETY AND STRENGTH OF WOOD TRUSS STRUCTURES" (now U.S. Pat. No. 10,239,225);

U.S. patent application Ser. No. 15/426,966 filed Feb. 7, 2017 by Steven R. Weinschenk, titled "AUTOMATED SYSTEM AND METHOD FOR LUMBER PICKING" (now U.S. Pat. No. 10,493,636); and U.S. patent application Ser. No. 15/658,026 filed Jul. 24, 2017 by Steven R. Weinschenk, titled "AUTOMATED MULTI-HEADED SAW AND METHOD FOR LUMBER (now U.S. Pat. No. 10,207,421)";

each of which is incorporated herein by reference in its entirety.

FIELD OF THE INVENTION

The present invention relates to devices and methods for truss manufacturing, and in particular to a truss-jigging system and method that includes a self-powered, self-moving, motorized jigging puck in a slot that operates to unlock from a current location in the slot, move itself along the slot to another desired new location and lock itself to the new location; the system optionally includes a location-measuring subsystem (such as a machine-vision system that communicates wirelessly with the jigging puck, and/or a location-indicating fiducial system engraved in the slot that is readable by the jigging puck) that provides feedback as to the current location of the jigging puck and optionally sends commands to the jigging puck to readjust its position and re-lock at the adjusted position; the system optionally includes a recharging station to which the jigging puck can connect to recharge its on-puck source of electrical power such as supercapacitor(s) or rechargeable batteries.

BACKGROUND OF THE INVENTION

Conventional jig-setting systems position lumber pieces on a truss-assembly table using pin carriages or pucks that are moved across the top surface of the slotted truss-assembly table in X and/or Y directions with a screw or chain (the pin carriages or pucks include a pin sticking through the table surface to position the lumber). These conventional systems permanently locate the pin carriages/pucks in the truss-assembly table so a lower-usage part of the truss-assembly table often has very expensive jigging sitting unused until a rare, larger truss needs to be built (e.g., the expensive rails of conventional systems are commonly in a location that is rarely used such as a normal parking spot for a roller gantry). Some conventional systems install a pin carriage/puck every two feet.

U.S. Pat. No. 8,109,493 by Jerome E. Koskovich, et al., titled "AUTOMATED TRUSS ASSEMBLY JIG SETTING SYSTEM," issued on Feb. 7, 2012, and is incorporated herein by reference. U.S. Pat. No. 8,109,493 describes a retrofitted automated truss assembly jig setting system and one or more removable plank units used therewith. Removable plank unit includes a pair of drive motors each connected to a motor plate that is fixed to the bottom surface of a plank. A pair of rods extends along the length of the plank and each is operatively connected to a motor such that activation of a motor rotates a rod. Puck assemblies are carried by rods and are linearly transposed along rods when motors are activated. A computerized control system is operatively connected to provide for automated positioning of pucks. Planks on existing truss assembly tables may be removed and replaced with removable plank units to turn a traditional truss assembly jigging table into an automated truss assembly jigging table.

U.S. Pat. No. 9,821,440 by Clyde R. Fredrickson, et al., titled "AUTOMATIC TRUSS JIG SETTING SYSTEM," issued on Nov. 21, 2017, and is incorporated herein by reference. U.S. Pat. No. 9,821,440 describes an automatic truss jig setting system that includes a table including a plurality of segments with a side edge of adjacent segments defining a slot. At least one pin assembly, and optionally a pair of pin assemblies, is movable independently of each other along the slot. Movement apparatus is provided for independently moving the pin assemblies along the slot. Each of the side edges of the segments associated with the slot defines a substantially vertical plane with a zone being defined between the substantially vertical planes of the side edges, and the movement apparatus is located substantially outside of the zone of the slot. The U.S. Pat. No. 9,821,440 invention may optionally include a system for handling the obstruction of pin assembly movement, and a system for keeping track of the position of the pin assembly when the pin assembly has encountered an obstruction.

U.S. Pat. No. 10,460,880 to Snyder issued Oct. 29, 2019 with the title "Capacitors having engineered electrodes with very high energy density and associated method" and is incorporated herein by reference. U.S. Pat. No. 10,460,880 describes an apparatus and associated method for an energy-storage device (e.g., a capacitor) having a plurality of electrically conducting electrodes including a first electrode and a second electrode separated by a non-electrically conducting region, and wherein the non-electrically conducting region further includes a non-uniform permittivity (K) value. In some embodiments, the method includes providing a substrate; fabricating a first electrode on the substrate; and fabricating a second electrode such that the second electrode is separated from the first electrode by a non-electrically conducting region, wherein the non-electrically conducting region has a non-uniform permittivity (K) value. The capacitor devices will find benefit for use in electric vehicles, of all kinds, uninterruptible power supplies, wind turbines, mobile phones, and the like requiring wide temperature ranges from several hundreds of degrees C. down to absolute zero, consumer electronics operating in a temperature range of −55 degrees C. to 125 degrees C.

SUMMARY OF THE INVENTION

In some embodiments, the present invention provides a jigging system that includes automated, self-powered jigging pucks that are moved by one or more friction wheels sticking into a slot in the table, and able to move themselves to any desired one of a plurality of selectable locations and then lock themselves in place. In some embodiments, the self-powered jigging pucks are battery powered (in other embodiments, a supercapacitor is used in place of batteries in order to provide faster charging times), and are able to move themselves and connect themselves to a recharging station, such as one or more such recharging stations located along one or more sides of the jigging table. In some embodiments, the present invention includes a method for correcting the position of the jigging puck that includes taking a picture of the puck (e.g., using cameras (in some embodiments, high-resolution digital-image or video cameras) located above the jigging table, wherein the cameras are by themselves or associated with, or located in, projection boxes that are capable of projecting test patterns for puck location determinization and/or lumber-layout patterns).

In some embodiments, the truss-jig-positioning system includes a truss-assembly table having a support plane on which work pieces are supported and a plurality of slots in the support plane, a plurality of puck assemblies automatically movable along the slots. Each puck is self-powered and self-locks at selected locations. A controller controls the pucks. Images of the truss-assembly table and pucks allow the controller to locate pucks, and transmit location-correction information as needed to move pucks to desired locations for building various trusses, wall assemblies, etc. Pucks are self-powered, self-moving, motorized jigging members. Each operates from controller commands to unlock from one location, move along their slot and lock to a new location. Optionally location-measuring (machine-vision) subsystem(s) communicate wirelessly with the pucks to readjust positions and re-lock at the adjusted position. Optionally, the jigging pucks can automatically move along slots to connect to a recharging station to self-recharge on-puck batteries or supercapacitors.

In some embodiments, once the puck "reports" (communicates signals to a controlling microprocessor) that the puck has reached what it "believes" (has sensed and calculated) to be its final position, the system uses imaging data from the overhead camera (which, in some embodiments, uses a process that includes projecting test location patterns that are detectable by the camera to locate the puck), and calculates a location-correction set of commands and issues these commands using a wireless communication to the puck of the correction distance and direction that the puck need to move, and/or a feedback of the puck's actual position in relation to the desired position (e.g., using the projection cameras). In some embodiments, each puck includes one or more indicia (i.e., an indicium, or a plurality of indicia) on a surface of the puck, wherein the indicia are readable by the camera for the identity of the puck and for the location and orientation of the puck (such as a bar code or quick-response (QR) code and orientation indicia that are read by the camera system so that location- and/or orientation-correction information can be calculated and transmitted to the puck). In other embodiments, the pucks include cameras or other optical sensors that obtain images or other optical data of indicia that the factory provides on, in, and/or under the slot, and/or on the ceiling of the factory room so that the puck can communicate to the computer system where, in the factory, the puck is located. This allows substitute pucks to be inserted into the production system in the case of a failure of a puck (such as a mechanical malfunction or an unexpected dead battery or overly discharged supercapacitor). In some embodiments, the pucks include light-emitting diodes (LEDs) and/or laser diodes (LDs) that emit coded light signals from point sources (e.g., pulsed patterns of light emitted from very small emitting areas (e.g., in some embodiments, spot sizes that are in a range of about 0.1 mm (100 microns or smaller) to 1 mm (1000 microns, or optionally larger in some embodiments) spaced across the top and/or side surfaces of the puck so that the cameras can identify and precisely determine the location and/or orientation and identification (such as a serial number) of each puck) that indicate the identity of the puck and that include a plurality of LEDs or LDs arranged as indicia at various locations on the puck. In other embodiments, the puck includes retro-reflective indicia so that projected light patterns from the ceiling-mounted projector-camera combinations can be changed from time-to-time to allow the identification, location and orientation of each puck to be determined. In some embodiments, any other suitable method and system is used to observe and/or correct the position of the jigging pucks, such as providing a plurality of projectors that project a line, and having the pucks drive to the line using a photo detector to get to the correct position.

In some embodiments, the jigging pucks are battery powered and are configured to move themselves to a self-charging station when not being used (e.g., between jobs and/or at night). In some embodiments, the pucks can be moved to any table slot at any time (e.g., manipulated by hand by a human operator) and the system uses camera images to determine which pucks are on a given slotted table and where each one of the identified pucks is on the table and adjusts each puck mission (the time sequence of locations to which the puck is moved) based on where it has been placed (this is important if multiple pucks are placed in the same slot because one puck might be located on the table near boards that will be at the top of the truss once it is completed, while others may be located on the table near boards that will be at the bottom of the truss or near the webs of the truss in the middle of the truss).

In some embodiments, the jigging pucks include a camera that takes pictures or other optical data of indicia that the factory provides on, in, and/or under the slot, and/or on the ceiling to get the puck's bearings (e.g., in some embodiments, the puck camera looks at Quick Response (QR) codes located on the ceiling or on or under the slot on the table). In some embodiments, the present invention includes ceiling camera(s) used to locate the jigging puck and provide adjustment information. In some embodiments where a factory has pre-existing truss-assembly tables, the present invention eliminates cutting out the old truss-assembly tables by being able to use the existing slots in the old table for the jigging pucks and camera-location equipment and/or other optional equipment of the present invention.

In some embodiments, the jigging pucks of the present invention are not permanent in the table so they can be re-positioned to other slots in the same truss setup or into another truss setup as needed. In some embodiments, the pucks include a way to communicate their identification to the controlling system (e.g., flashing a pulse-encoded light signal from a top-side LED so that one or more overhead cameras can identify both which puck is flashing and what the location is of that puck) so that pucks can be given their new location on the slotted table depending on need in that area of the truss setup. In some embodiments, the pucks communicate with a controller connected to the overhead camera(s) to get a corrected position and the location where the pucks should be moved to and locked in that stopped location. In some embodiments, the pucks are able to go to the location by themselves using a self-contained power source and motorized actuators such as rubber wheels that press against the table inside or above or below the slot in the table. In some embodiments, the pucks have their own cameras or other imaging devices that look at the surroundings (such as ruled and encoded lines on the slot) to determine how far they have moved. For example, in some embodiments, the pucks are given a relative move distance and a direction from a controller via wireless communications such as infrared (IR), WIFI, Bluetooth® or similar such signals). In some embodiments, the pucks are given an absolute move, wherein electronic components 160 of each puck (e.g., microprocessors, sensors, light emitters, sound emitters) determines the puck's location by tracking the objects above or beside the puck or from feedback from the other pucks on the truss-assembly table. In some embodiments, projectors located above the truss-assembly table project a line on the truss-assembly table and the puck senses and uses the projected line to position itself.

In some embodiments, the jigging pucks are electrically powered by rechargeable batteries. In some other embodiments, the jigging pucks are electrically powered by supercapacitors, since supercapacitors can be recharged in a shorter period of time than is possible if recharging batteries. In some such embodiments, the pucks are configured to automatically drive, under certain conditions (such as low on-board electrical power remaining in the batteries or supercapacitors) to a charging station, such as one or more located along an edge of the truss-assembly table (in some embodiments, the pucks are configured to stack against each other side-by-side in a slot connected to the recharging station to provide recharging power to multiple pucks in one slot at once). In other such embodiments, the pucks are pulled out of the truss-assembly table (e.g., by a human operator) and placed in a charging station. In some embodiments, the discharged batteries and/or supercapacitors are configured to be replaced by batteries and/or supercapacitors that were recharged outside the puck.

In some embodiments, the jigging pucks are elongated rectangular prisms with rounded ends or corners, while in other embodiments, the jigging pucks are elongated cylindrical prisms. In still other embodiments, the jigging pucks are square or triangular prisms or other-polyhedron prism shapes, optionally with rounded ends or corners.

BRIEF DESCRIPTION OF THE FIGURES

FIG. 1A1 is a perspective top view of a jigging puck assembly 101, according to some embodiments of the present invention.

FIG. 1A2 is a partially exploded perspective bottom view of jigging puck assembly 101, according to some embodiments of the present invention.

FIG. 1A3 is another partially exploded perspective bottom view of jigging puck assembly 101, according to some embodiments of the present invention.

FIG. 1A4 is partially exploded perspective bottom view of a jigging puck assembly 104, according to some embodiments of the present invention.

FIG. 4 is a perspective view schematic of a jigging table and projector-imaging system 400 having puck-identification and moving functions with a plurality of digital cameras 401 (e.g., 401A-401D) that each obtain input images, and projectors 402 (e.g., 402A-402D) that each project output images with distortion correction that compensates for projector and table distortions and imperfections, according to some embodiments of the present invention.

COPYRIGHT NOTICE/PERMISSION

Figure 1B:
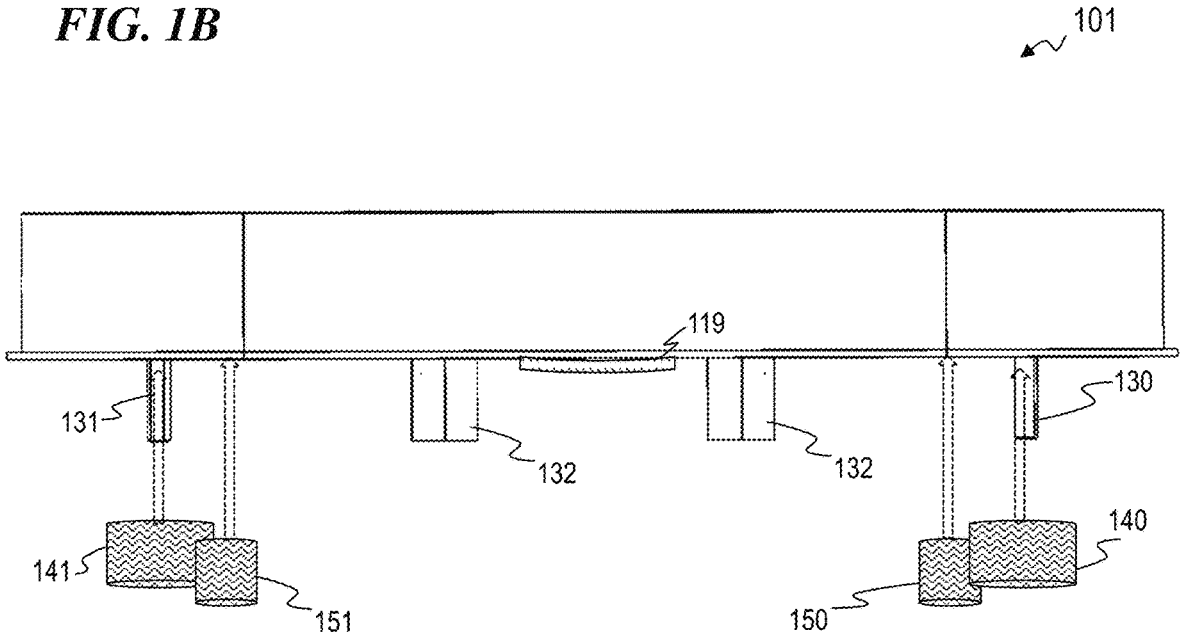
FIG. 1B is a first partially exploded side view of puck assembly 101, according to some embodiments of the present invention.

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described herein and in the drawings attached hereto: Copyright © 2018-2019, Steven R. Weinschenk, All Rights Reserved.

DETAILED DESCRIPTION OF THE INVENTION

Although the following detailed description contains many specifics for the purpose of illustration, a person of ordinary skill in the art will appreciate that many variations and alterations to the following details are within the scope of the invention. Specific examples are used to illustrate particular embodiments; however, the invention described in the claims is not intended to be limited to only these examples, but rather includes the full scope of the attached claims. Accordingly, the following preferred embodiments of the invention are set forth without any loss of generality to, and without imposing limitations upon the claimed invention. Further, in the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

It is specifically contemplated that the present invention includes embodiments having combinations and subcombinations of the various embodiments and features that are individually described herein (i.e., rather than listing every combinatorial of the elements, this specification includes descriptions of representative embodiments and contemplates embodiments that include some of the features from one embodiment combined with some of the features of another embodiment, including embodiments that include some of the features from one embodiment combined with some of the features of embodiments described in the patents and application publications incorporated by reference in the present application). Further, some embodiments include fewer than all the components described as part of any one of the embodiments described herein.

The leading digit(s) of reference numbers appearing in the Figures generally corresponds to the Figure number in which that component is first introduced, such that the same reference number is used throughout to refer to an identical component which appears in multiple Figures. Signals and connections may be referred to by the same reference number or label, and the actual meaning will be clear from its use in the context of the description.

Certain marks referenced herein may be common-law or registered trademarks of third parties affiliated or unaffiliated with the applicant or the assignee. Use of these marks is for providing an enabling disclosure by way of example and shall not be construed to limit the scope of the claimed subject matter to material associated with such marks.

FIG. 1A1 is a perspective view of a jigging puck assembly 101, according to some embodiments of the present invention. In some embodiments, the lip 115 and most of the bottom surface 117 (see FIG. 1A2) provides an insulating layer (e.g., of a polymer such as polyethylene or the like) between puck assembly 101 and the truss-assembly table (usually made of a metal such as steel or brass or the like, for example), such that electricity is not conducted between puck assembly 101 and the truss-assembly table except through grounding strap 119 (see FIG. 1A2), which, in some embodiments, is bow shaped as a spring electrical contact to accommodate the different heights that may occur during moving or locking of the puck, or the like. In some embodiments, electrically conductive end surfaces 116 or electrically conductive plug-in connector(s) 118 are used to connect to recharging stations along sides of the table. In some embodiments, puck assembly 101 is configured to couple to the channels/slots that are already present in conventional truss-assembly tables (e.g., in some embodiments, puck assembly 101 can be used without having to reconfigure/build a new truss-assembly table). In some embodiments, motors 120 and 121 drive elastomeric drive wheels 140 and 141 located under the puck and within slots that exist in the jigging table. In some embodiments, locking-drive system 122 includes motor 124 having wiring 123 (only a portion of which is shown here) and a two-output transmission gear system 125.

FIG. 1A2 is a partially exploded perspective bottom view of a jigging puck assembly 101, according to some embodiments of the present invention. In some embodiments, motors 120 and 121 (see FIG. 1A1) drive shafts 130 and 131, respectively, that are connected to elastomeric drive wheels 140 and 141, respectively, located under the puck and within slots that exist in the jigging table. In some embodiments, secondary wheels 150 and 151, respectively, provide a balancing force on an opposite edge of the slot relative to drive wheels 140 and 141. Thus, for example, when drive wheel 140 is rotating clockwise and urged against a left-hand edge of the slot, secondary wheel 141 is rotating counterclockwise and urged against a right-hand edge of the slot, and both wheels drive the puck in the same direction along their respective sides of the slot. As will be readily understood by persons of skill in the art, the wheels 140, 141, 150 and 151 are shown displaced from their respective drive shafts (130 and 131) and idler shafts (not shown here) for clarity of illustration. In some embodiments, locking-drive system 122 includes the two-output transmission gear system 125 that drive rotary locking-shaped devices 132 to lock the position of puck assembly 104 in a desired location and orientation in the slots 312 (see FIG. 3) in the jigging table 309 (see FIG. 3).

Figure 1C:
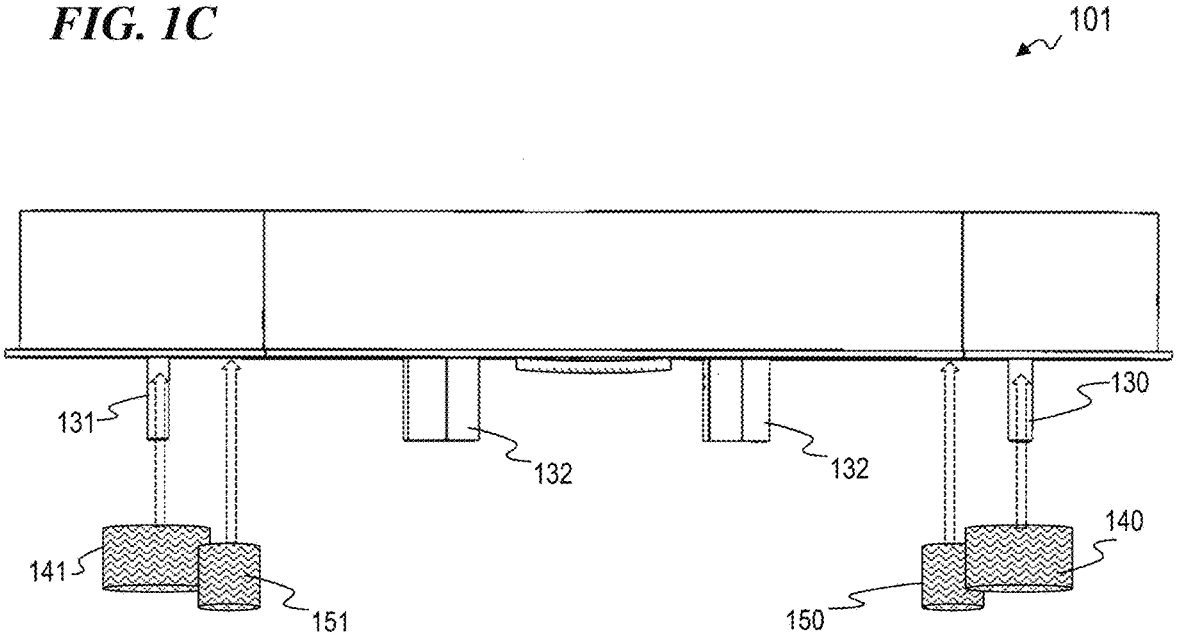
FIG. 1C is a partially exploded second side view of puck assembly 101, according to some embodiments of the present invention.
Figure 1D:
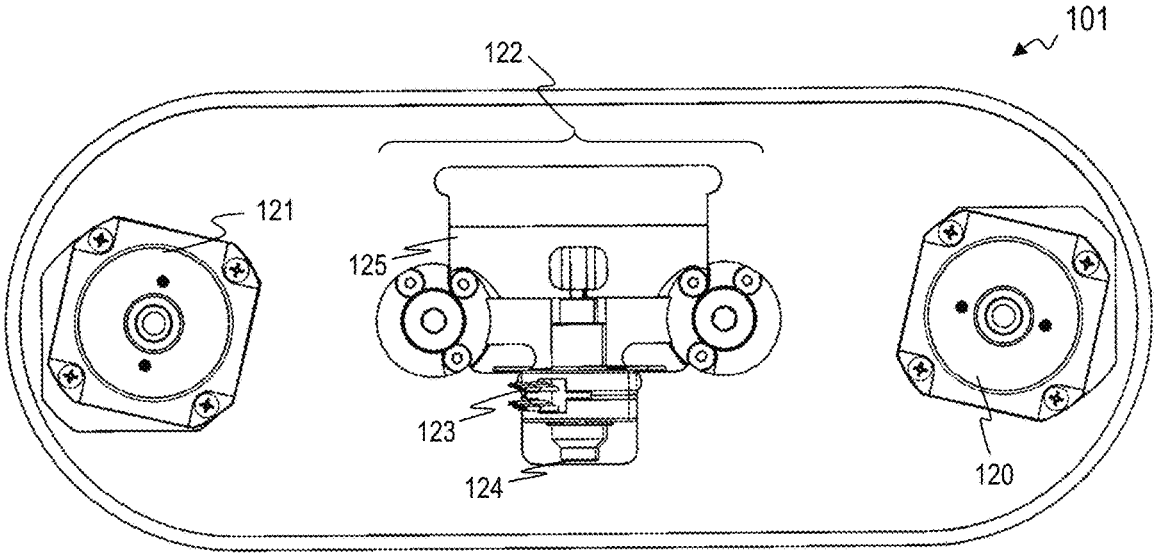
FIG. 1D is a top view of puck assembly 101, according to some embodiments of the present invention.

In other embodiments (as shown in FIG. 1D), two-output transmission gear system 125 drives a rotary gear 125' located between opposite facing wedge shapes 132' each having a linear gear face surface facing the rotary gear, in order to provide a readily unlockable locking function. In still other embodiments, any suitable locking mechanism (such as electromagnets or the like) can be used.

FIG. 1A3 is another partially exploded perspective bottom view of a jigging puck assembly 101, according to some embodiments of the present invention. This view shows spring mechanisms within the locking shapes, according to some embodiments.

Figure 3A:
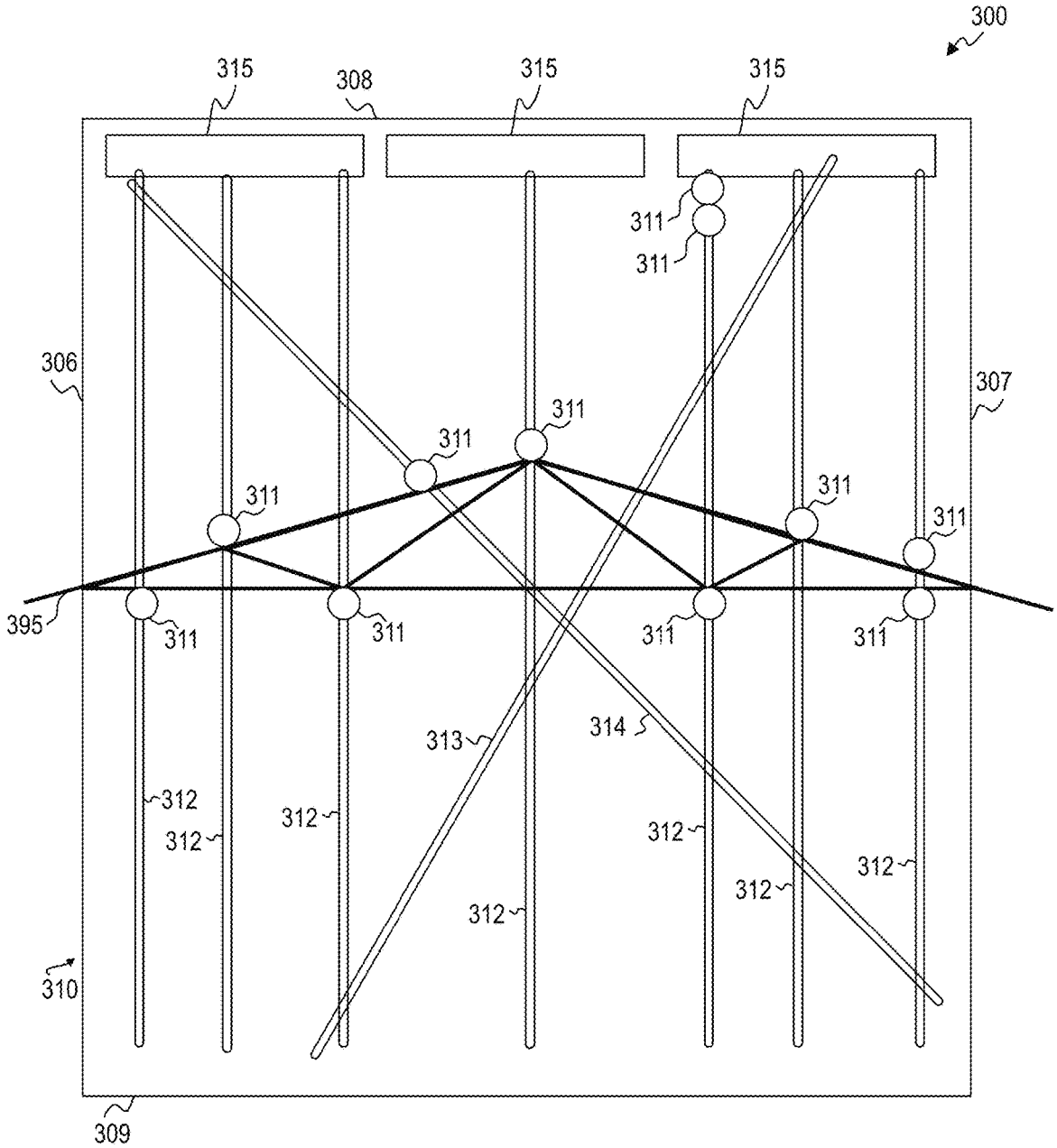
FIG. 3A is a plan-view schematic of a jigging-table system 300, according to some embodiments of the present invention.
Figure 3B:
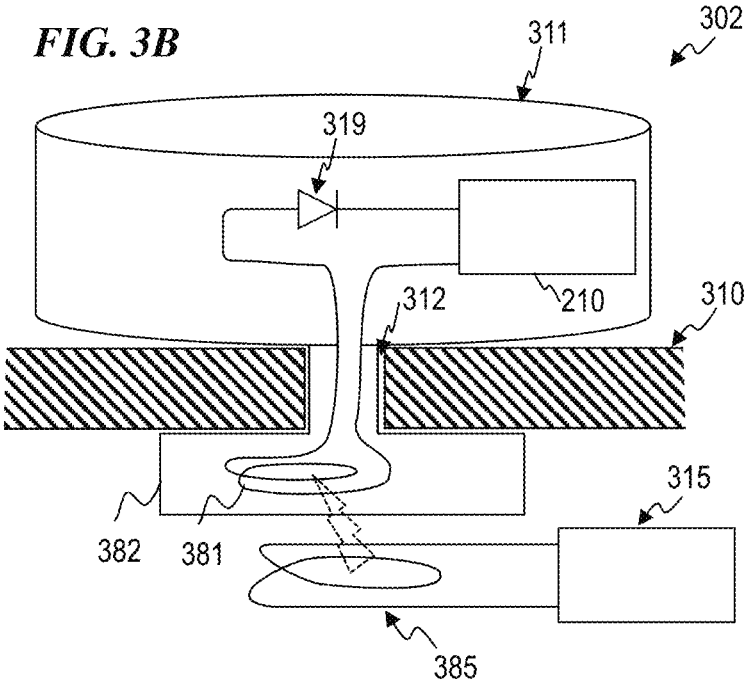
FIG. 3B is a side-view schematic, partially in cross section, of a jigging-table recharging system 302, according to some embodiments of the present invention.
Figure 3C:
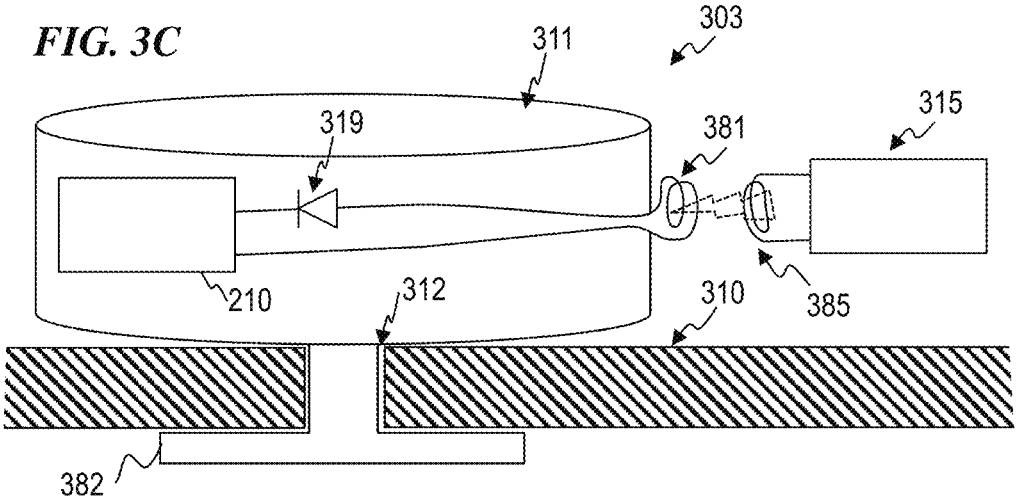
FIG. 3C is a side-view schematic, partially in cross section, of a jigging-table recharging system 303, according to some embodiments of the present invention.
Figure 3D:
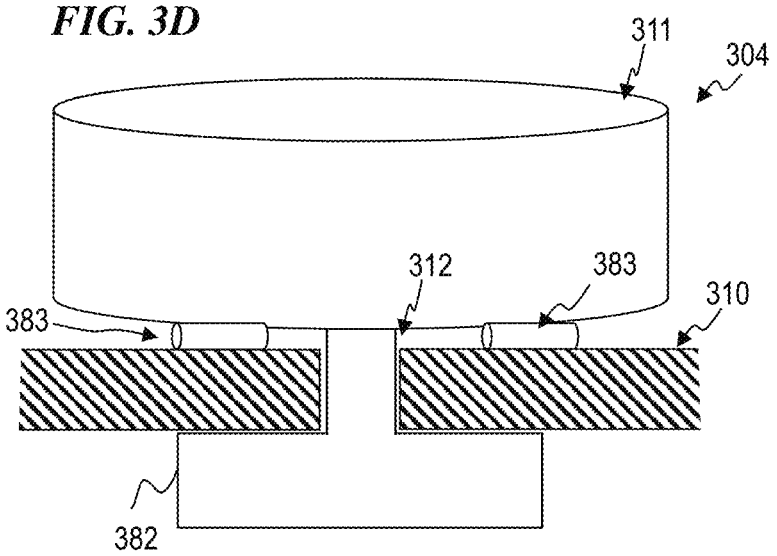
FIG. 3D is a side-view schematic, partially in cross section, of a jigging-puck top-side drive system 304, according to some embodiments of the present invention.
Figure 3E:
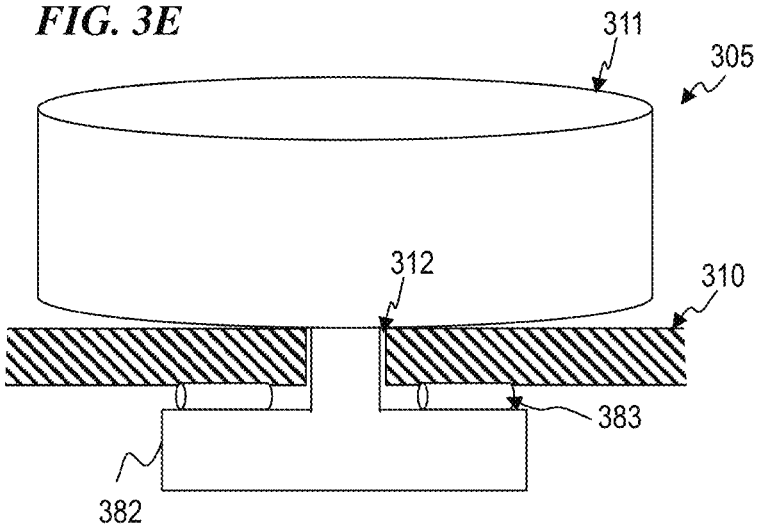
FIG. 3E is a side-view schematic, partially in cross section, of a jigging-puck bottom-side drive system 305, according to some embodiments of the present invention.
Figure 3F:
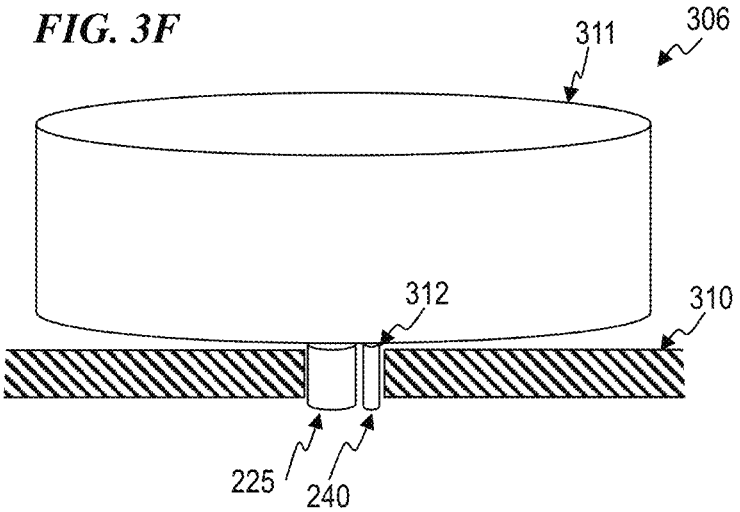
FIG. 3F is a side-view schematic, partially in cross section, of a jigging-puck in-slot drive system 306, according to some embodiments of the present invention.
Figure 4:
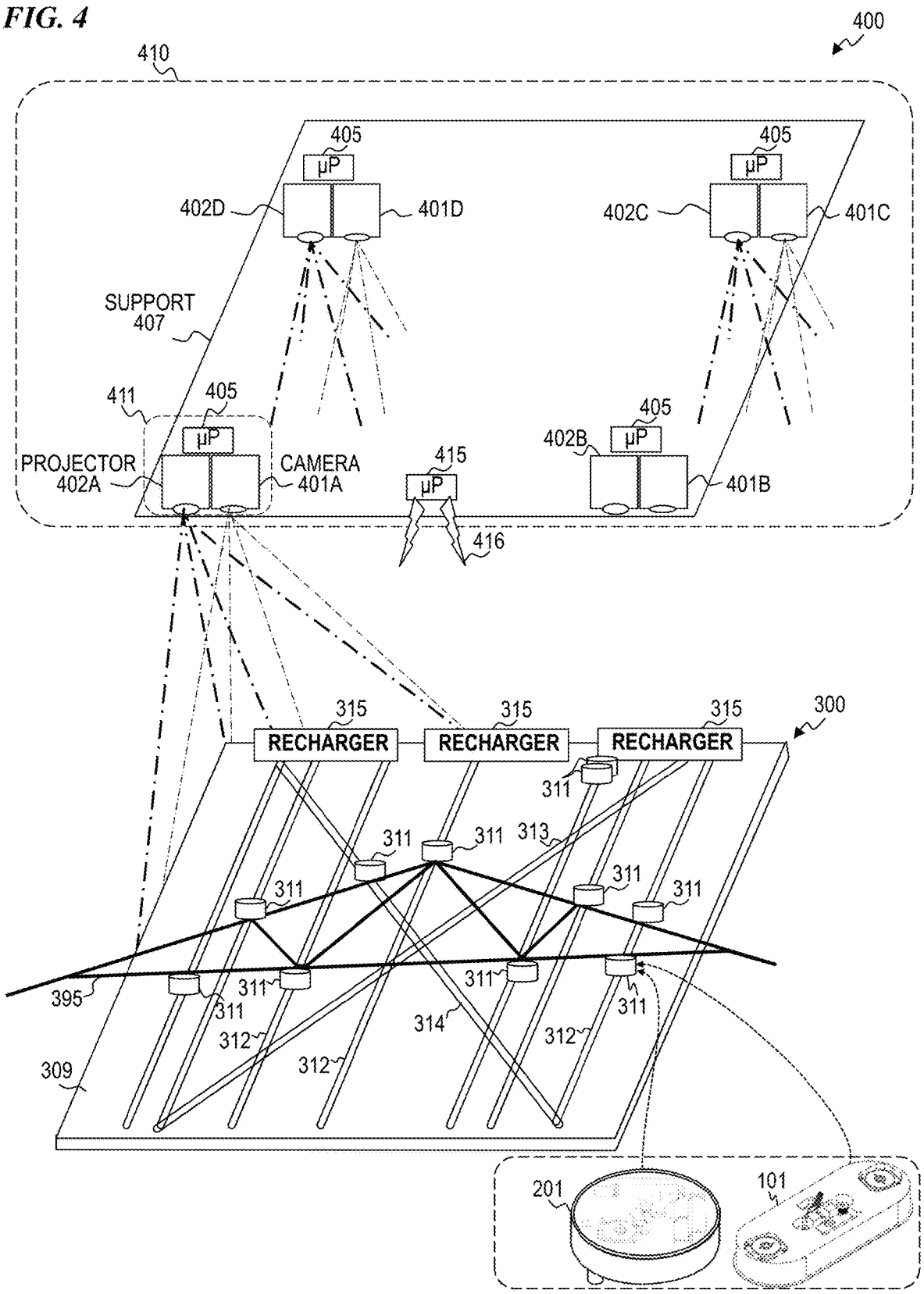

FIG. 1A4 is partially exploded perspective bottom view of a jigging puck assembly 104, according to some embodiments of the present invention. In some embodiments, jigging puck assembly 104 is substantially similar to jigging puck assembly 101, but with the substitution of the locking mechanism 139 in place of locking units 132. In some embodiments, locking mechanism 139 includes cylindrical gear 135 and two triangular gear-faced prisms 134 that move along slots 133 in puck assembly 104 to lock the position of puck assembly 104 in the slots 312 (see FIG. 3) in the jigging table 309 (see FIG. 3).

FIG. 1B is a partially exploded first side view of puck assembly 101, according to some embodiments of the present invention. The parts and reference numbers are explained above for cylindrical elastomeric drive wheels 140 and 141, idler wheels 150 and 151, rotatable drive shafts 130 and 131, and locking shapes 132, and bottom-side electrical contact 119, according to some embodiments of the present invention.

FIG. 1C is partially exploded a second side view of puck assembly 101, according to some embodiments of the present invention.

FIG. 1D is a top view of puck assembly 101, according to some embodiments of the present invention. The parts and reference numbers are explained above for puck-motion motors 120 and 121, locking-drive system 122 that includes motor 124 having wiring 123 and a two-output transmission gear system 125, according to some embodiments of the present invention.

Figure 1E:
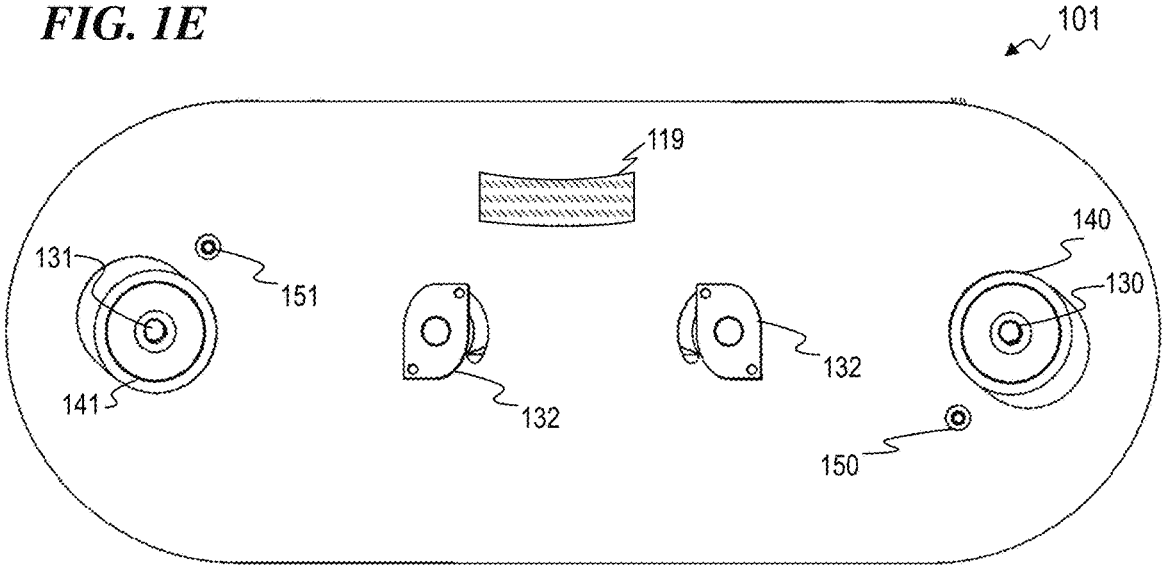
FIG. 1E is a bottom view of puck assembly 101, according to some embodiments of the present invention.

FIG. 1E is a bottom view of puck assembly 101, according to some embodiments of the present invention. The parts and reference numbers are explained above for cylindrical elastomeric drive wheels 140 and 141 located to press against opposite side walls of slots 312 (see FIG. 3) in the jigging table 309 (see FIG. 3) as do idler wheels 150 and 151. In some embodiments, elastomeric drive wheels 140 and 141 are driven by rotatable drive shafts 130 and 131. In some embodiments, locking shapes 132 are rotatable to press against opposite side walls of slots 312 to lock puck assembly 101 at a desired location along its respective slot 312. In some embodiments of the present invention, bottom-side electrical contact 119 provides a grounding contact to jigging table 309 (see FIG. 3).

In some embodiments, puck assembly 101 includes electrical connectors on both ends such that a plurality of puck assemblies 101 connect to one another end-to-end and to a single charging station 315 on an edge (or, in some embodiments, on two or more edges) of jigging table 309 (see FIG. 3) in order to recharge the batteries (see batteries 210 described below) that power each puck assembly 101. In some embodiments, each puck assembly 101 includes electronic components 160 having one or more microprocessors, sensors, light emitters, sound emitters, motor drive electronics, wireless communications transmitter(s) and receiver(s) and/or cameras that provide data gathering and processing in order to provide a "smart" puck.

Figure 2A:
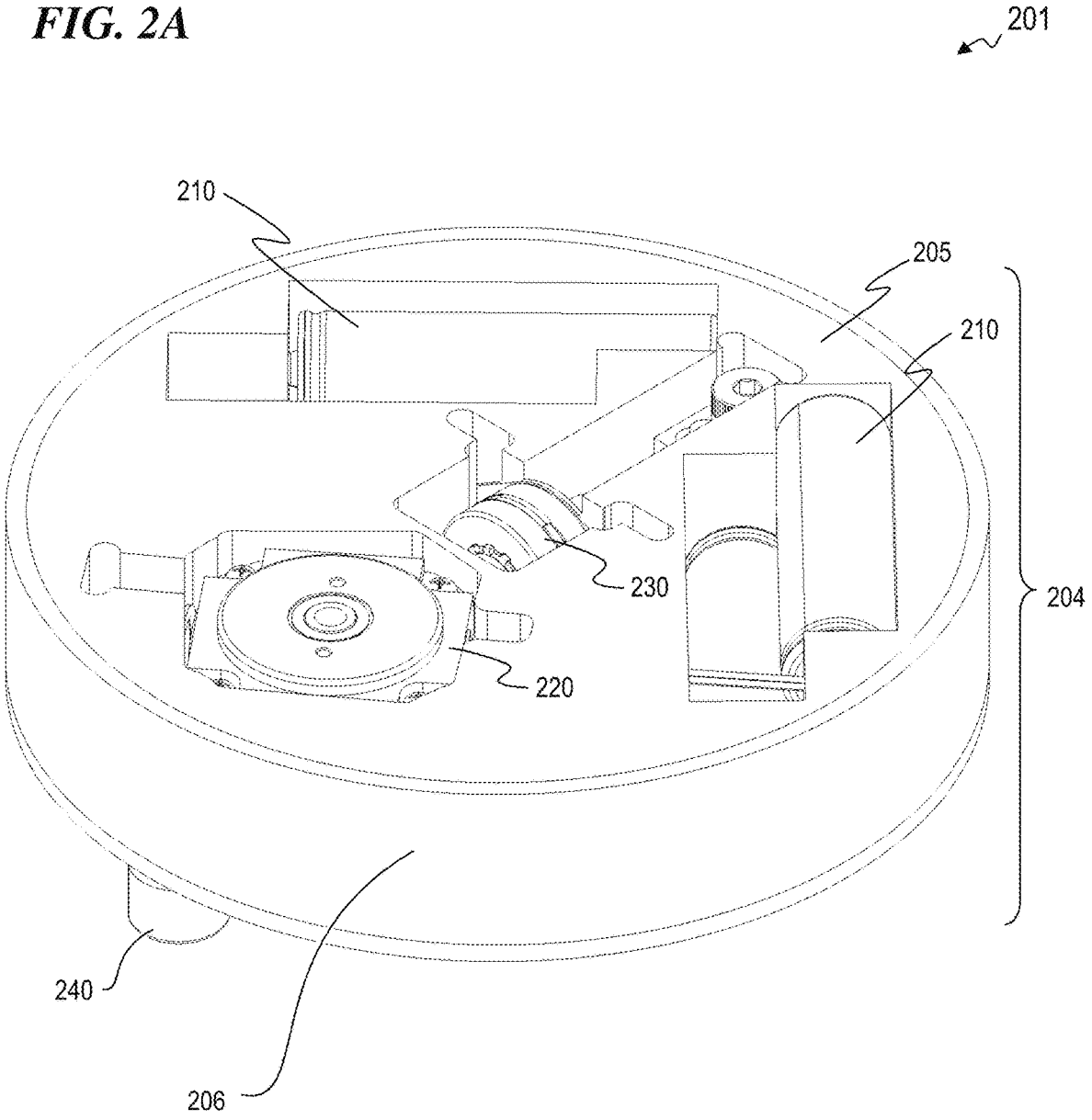
FIG. 2A is a perspective view of a cylindrical jigging puck assembly 201, according to some embodiments of the present invention.

FIG. 2A is a perspective view of a jigging puck assembly 201, according to some embodiments of the present invention. In some embodiments, puck assembly 201 is cylindrical in shape (having a circular base and top face) and is configured to couple to a slot along a truss-assembly table (e.g., in some such embodiments, components on the bottom side of puck assembly 201 (visible in FIG. 2C) fit into the slot through and/or below the work surface of the truss-assembly table, while the main portion 204 of puck assembly 201 is located above the work surface of the truss-assembly table such that puck assembly 201 can be used to guide the location of a truss piece placed on the work surface of the truss-assembly table). In some embodiments, puck assembly 201 includes a main portion 205 that is made from a molded plastic polymer material, and a ring portion 206 that includes a conducting metal (e.g., brass, bronze, stainless steel, or the like), and in some such embodiments, ring portion 206 includes the conducting metal such that two or more pucks 201 can line up against and touching each other (i.e., in electrical contact with each other) and share a charging session in the same slot from a single charging station in order to recharge the power source 210 (such as batteries, supercapacitors or the like) that power each puck assembly 201). In some embodiments, the conducting ring 206 and bottom contact 119 (see FIG. 2C) provide the two or more electrical contacts used for recharging the puck assemblies 201. In some embodiments, puck assembly 201 includes a cover (not illustrated in FIG. 2A) to protect the components contained within puck assembly 201. In other embodiments, the present invention uses contactless (also called wireless) recharging such is commonly used for recharging cell phones and the like, wherein the recharging station 315 (see FIG. 3A, FIG. 3B, and FIG. 3C) includes an RF antenna or coil that transmits power via RF energy (or, in some other embodiments, other frequencies of alternating current (AC) electromagnetic (EM) energy), and the pucks 311 (such as puck assemblies 101 or 201) each includes a coil or RF receiver antenna system that receives and rectifies the RF or EM energy to recharge the on-puck power source 210. In some embodiments, the coil 385 of the recharging station 315 and the coil 381 of the puck 311 are coupled by near-field EM coupling to act as a transformer to pass EM energy (at 60 Hz or other suitable frequency) from coil 385 to coil 381. In some embodiments, each of one or more recharging stations 315 includes RF antenna(s) or EM coil(s) located at one or more locations along an underside of one or more of the slots so that the pucks 311 can receive the RF or EM energy without actual electrical contact to the recharging station.

In some embodiments, power source 210 includes supercapacitors, also called ultracapacitors, that are high-capacity capacitors with a capacitance value much higher than other capacitors (e.g., in some embodiments, each supercapacitor being one to five-hundred farads and a plurality of such being connected in series if needed to comply with voltage limits), but with typically lower voltage capabilities each, that are used instead of rechargeable batteries (definition adapted from en.wikipedia.org/wiki/Supercapacitor). One amp represents a rate of electron flow of 1 coulomb of electrons per second, so a 1-farad capacitor can hold 1 amp-second of electrons at 1 volt. Accordingly, a 10-farad supercapacitor could be charged to 6 volts in 60 seconds. In some embodiments, the power supply 210 includes a supercapacitor circuit having a capacitance of at least 0.1 farad. In some embodiments, the power supply 210 includes a supercapacitor circuit having a capacitance of at least 0.2 farad. In some embodiments, the power supply 210 includes a supercapacitor circuit having a capacitance of at least 0.5 farad. In some embodiments, the power supply 210 includes a supercapacitor circuit having a capacitance of at least 1 farad. In some embodiments, the power supply 210 includes a supercapacitor circuit having a capacitance of at least 2 farads. In some embodiments, the power supply 210 includes a supercapacitor circuit having a capacitance of at least 5 farads. In some embodiments, the power supply 210 includes a supercapacitor circuit having a capacitance of at least 10 farads. In some embodiments, the power supply 210 includes a supercapacitor circuit having a capacitance of at least 20 farads. In some embodiments, the power supply 210 includes a supercapacitor circuit having a capacitance of at least 50 farads. In some embodiments, the power supply 210 includes a supercapacitor circuit having a capacitance of at least 100 farads. In some embodiments, power source 210 includes a supercapacitor circuit having two 200-farad capacitors of a type similar to part LIC2540R 3R8207, or two 270-farad capacitors of a type similar to part LIC2540RS3R8277, each by TAIYO YUDEN CO., LTD., as described at www.mouser.com/datasheet/2/396/taiyoyuden_capacitor03_e-1488112.pdf, are wired in series to provide at least 100-farad capacitance that can be charged to at least 7.4 volts and discharged to 4.4 volts before needing to be recharged. To recharge 100 farads (100 Coulombs/volt) by a 3-volt difference (i.e., 4.4 volts to 7.4 volts) the power-supply circuit 210 needs 300 Coulombs, which charged at 5 amps (5 coulombs/second), would take 60 seconds. In some embodiments, supercapacitors such as described by Snyder in U.S. Pat. No. 10,460,880 are used. In some embodiments, supercapacitors can be charged and discharged tens of thousands or hundreds of thousands of times, whereas rechargeable batteries can typically be recharged only up to one thousand times. Thus, a power source 210 that includes supercapacitors can be recharged much more quickly (a few seconds) and for many more times (tens of thousands to hundreds of thousands of times) than is possible using rechargeable batteries. In some embodiments, each supercapacitor-powered puck assembly 101 or 201 is recharged in one to sixty seconds once per hour rather than the one to eight hours once per day needed to recharge a rechargeable battery-powered puck assembly 101 or 201.

In some embodiments, puck assembly 201 includes an electronic motor 220 that is coupled to and configured to drive a friction wheel 225 (see FIG. 2C) that contacts a sidewall of the slot in the truss-assembly table where puck assembly 201 is located. In some such embodiments, motor 220 drives wheel 225 along the sidewall such that puck assembly 201 moves along the slot in the truss-assembly table. In some embodiments, puck assembly 201 includes a brake motor 230 that actuates braking-locking mechanism 231 (see FIG. 2C) that provides a braking and/or locking force to puck assembly 201 such that it is held in place in the slot 312 or 313 (see FIG. 3) once puck assembly 201 has reached a desired location in the slot 312 or 313. In some embodiments, puck assembly 201 includes one or more sensors 240 that are configured to provide location information to puck assembly 201 and/or a control system that controls puck assembly 201. In some embodiments, sensors 240 include infrared (IR) sensors, cameras, touch/contact/distance sensors, or the like. In some embodiments, the slots 312 or 313 include optical, engraved, or other rulings that are sensed by sensors 240. In some embodiments, sensors 240 include idler-wheel outer side surfaces that provide a contralateral pressure on the sides of the slots relative to the drive wheel 225. In other embodiments, braking-locking mechanism 231 provides the contralateral pressure on the sides of the slots relative to the drive wheel 225. In yet other embodiments (such as shown in FIG. 1E), separate idler wheels or other physical features of the puck assembly 201 provide the contralateral pressure on the sides of the slots relative to the drive wheel 225 such that when drive wheel 225 rotates and presses against the slot 312 or 313, the puck is moved along the respective slot 312 or 313.

Figure 2B:
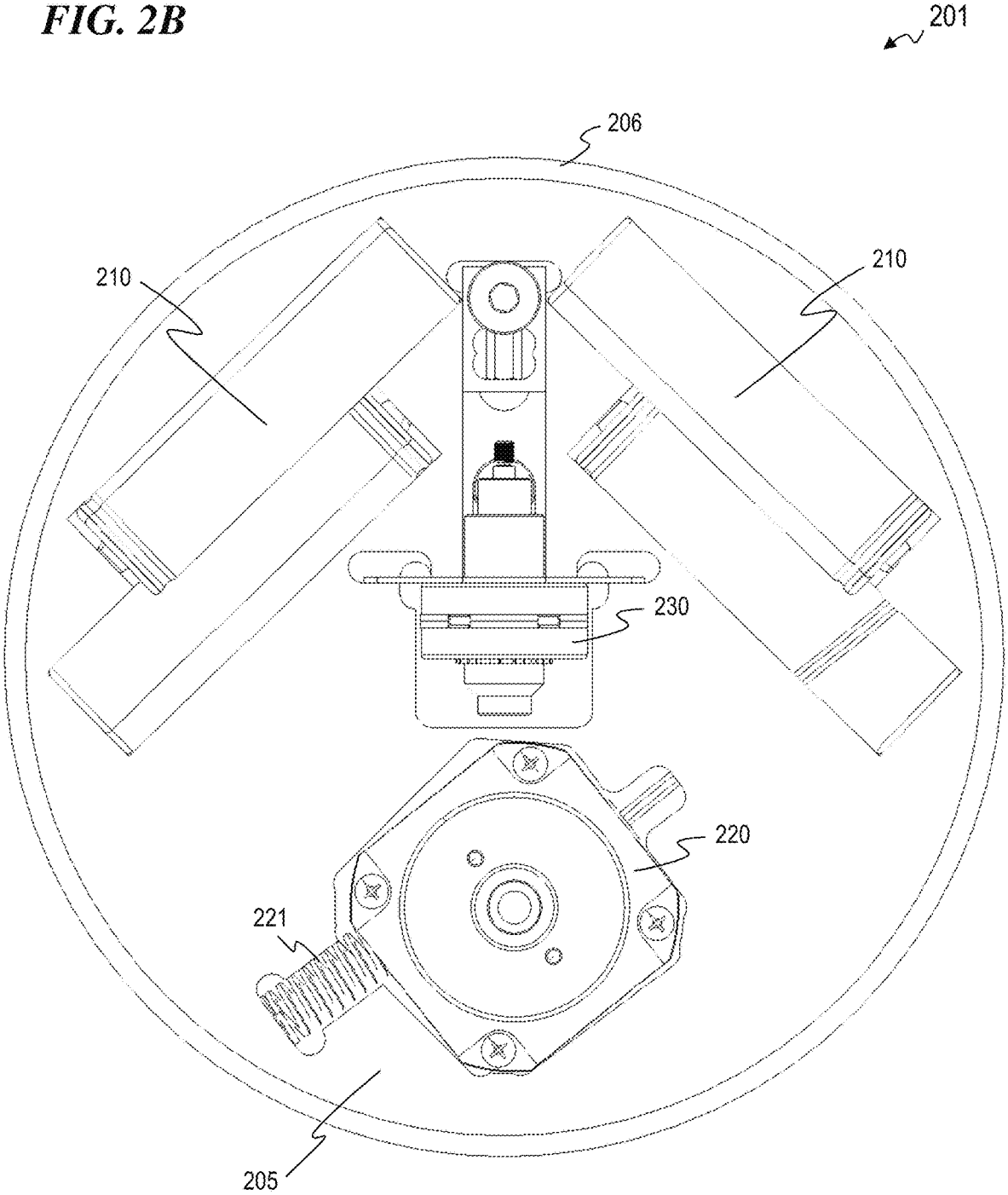
FIG. 2B is a top view of puck assembly 201, according to some embodiments of the present invention.

FIG. 2B is a top view of puck assembly 201, according to some embodiments of the present invention. In some embodiments, motor 220 (and thus wheel 225) is coupled to a spring 221 such that wheel 225 is spring-loaded against the sidewall of the slot regardless of how the sidewall width changes along the length of the slot.

Figure 2C:
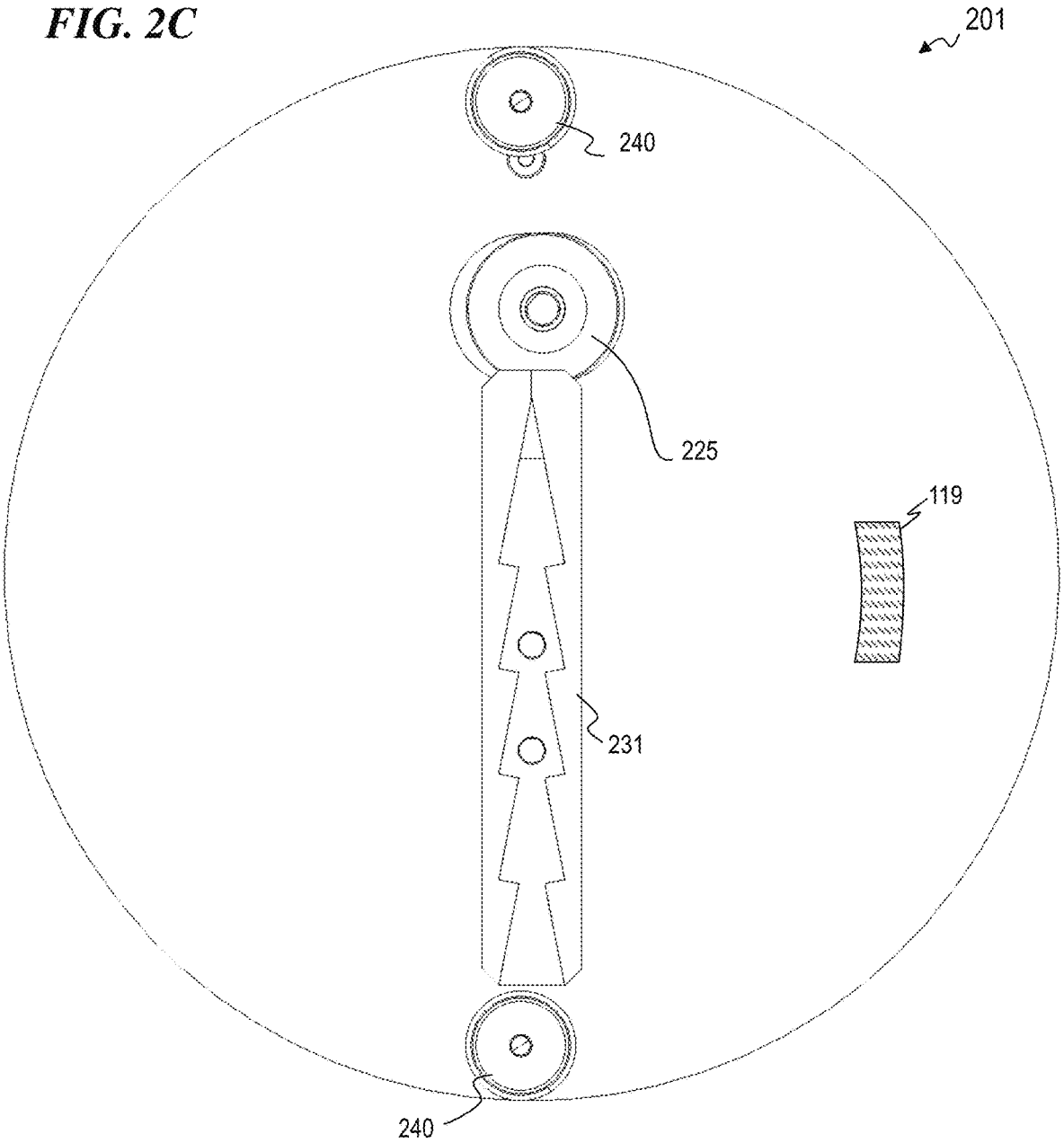
FIG. 2C is a bottom view of puck assembly 201, according to some embodiments of the present invention.

FIG. 2C is a bottom view of puck assembly 201, according to some embodiments of the present invention. In some embodiments, puck assembly 201 includes braking/locking device 231 that is coupled to and controlled by brake mechanism 230 (see FIG. 2B).

Figure 2D:
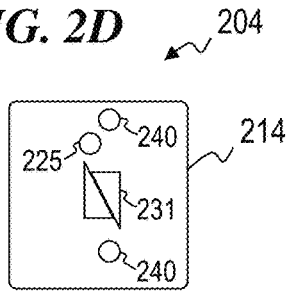
FIG. 2D is a bottom view of a square-prism puck assembly 204, according to some embodiments of the present invention.

FIG. 2D is a bottom view of a square-prism puck assembly 204, according to some embodiments of the present invention. As used herein, a square prism is a three-dimensional shape with two substantially square bases (a square bottom base and a top face of the same size and shape, although in some embodiments, the corners may be rounded) and four flat sides that connect the edges of the bottom base to corresponding edges of the top face. In some embodiments, as shown here, square-prism puck assembly 204 includes a generally square housing 214 with optionally rounded corners, sensors/idler wheels 240, drive wheel(s) 225 and braking-locking mechanism 231, as well as internal power source(s), motor(s), microprocessor(s) and wireless communications features (not shown here) to allow the overall system to locate, move, lock, and recharge puck assembly 204.

Figure 2E:
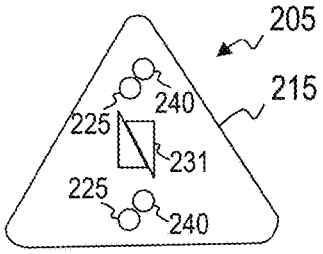
FIG. 2E is a bottom view of triangular-prism puck assembly 205, according to some embodiments of the present invention.

FIG. 2E is a bottom view of triangular-prism puck assembly 205, according to some embodiments of the present invention. As used herein, a triangular prism is a three-sided prism that has a triangular base and top face that is the size and shape of the base (although in some embodiments, the corners may be rounded), and three side faces joining corresponding edges of the base and top face. In some embodiments, as shown here triangular-prism puck assembly 205 includes a generally triangular housing 215 with optionally rounded corners, sensors/idler wheels 240, drive wheel(s) 225 and braking-locking mechanism 231, as well as internal power source(s), motor(s), microprocessor(s) and wireless communications features (not shown here) to allow the overall system to locate, move, lock, and recharge triangular-prism puck assembly 205.

Other features of square-prism puck assembly 204 and triangular-prism puck assembly 205 are similar to corresponding features of puck assembly 201, as described above.

FIG. 3A is a plan-view schematic of a jigging table system 300, according to some embodiments of the present invention. In some embodiments, jigging table system 300 includes a table surface 310 having a plurality of slots 312 running from a front edge 309 (at the bottom of FIG. 3) to one or more power recharging stations 315 situated at a distal back edge 308 generally parallel to the side edges 306 and 307. In some embodiments, the present invention further includes one or more diagonal slots 313 and 314 (or one or more slots perpendicular to slots 312), which, in the case of diagonal slot 314, allows the pucks 311 to switch among the slots 312 by their own motorized capabilities. In some embodiments, each of the plurality of pucks 311 are implemented by using puck assemblies 101 or 201 or the like.

FIG. 3B is a side-view schematic, partially in cross section, of a jigging-table recharging system 302, according to some embodiments of the present invention. In some embodiments, recharging system 302 includes one or more recharging stations 315 each includes one or more electromagnetic (EM) energy-transmitting coils 385 located under the slots 312, and each puck 311 includes an EM-energy-receiving coil 381 configured to receive EM energy when EM-energy-receiving coil 381 is located adjacent to, or in the vicinity of, EM-energy-transmitting coil 385. In some embodiments, each puck 311 includes a rectifying and signal-conditioning circuit 319 configured to receive AC power from its coil 381 and to provide DC recharging current to the puck's on-puck batteries or supercapacitors. While FIG. 3B and FIG. 3C show rectifying and signal-conditioning circuit 319 as a single diode (i.e., a half-wave rectifier), other embodiments use a full-wave bridge rectifier with over-voltage protection and other signal-conditioning circuitry, as are well-known in the art.

FIG. 3C is a side-view schematic, partially in cross section, of a jigging-table recharging system 303, according to some embodiments of the present invention. In some embodiments, recharging system 303 is similar in concept to system 302, but includes one or more recharging stations 315 that each includes one or more electromagnetic (EM) energy-transmitting coils 385 located above table 310 and at the end of the slots 312, and each puck 311 includes an EM-energy-receiving coil 381 on a side or edge of puck 311 configured to receive EM energy when EM-energy-receiving coil 381 is located adjacent to, or in the vicinity of, a corresponding EM-energy-transmitting coil 385.

FIG. 3D is a side-view schematic, partially in cross section, of a jigging-puck top-side drive system 304, according to some embodiments of the present invention. In some embodiments, each puck 311 of jigging-puck top-side drive system 304 includes one or more drive wheels 383 that press against the top surface of table 310, and includes a projection 382 that provides a balancing force to the bottom side of the table next to the respective slot 312.

FIG. 3E is a side-view schematic, partially in cross section, of a jigging-puck bottom-side drive system 305, according to some embodiments of the present invention. In some embodiments, each puck 311 of jigging-puck top-side drive system 305 includes a projection 325 that extends through the respective slot 312 and has one or more drive wheels 383 that press against the bottom surface of table 310, wherein the puck above the slot 312 provides a balancing force to the top side of the table next to the respective slot 312.

FIG. 3F is a side-view schematic, partially in cross section, of a jigging-puck in-slot drive system 306, according to some embodiments of the present invention. In some embodiments, jigging-puck in-slot drive system 306 is equivalent to those shown in FIGS. 1A1-1A4, 1B, 1C, 1D, 1E and 2A-2C.

FIG. 4 is a schematic of a jigging table and projector-imaging system 400 having puck-identification and moving functions with a plurality of digital cameras 401 (e.g., 401A-401D) that each obtain input images, and projectors 402 (e.g., 402A-402D) that each project output images with distortion correction that compensates for projector and table distortions and imperfections, according to some embodiments of the present invention. In some embodiments, each of the plurality of pucks 311 are implemented by using puck assemblies 101 or 201 (such as represented in the lower right corner of FIG. 4) or the like. In some embodiments, a puck-control microprocessor 415 uses wireless communications 416 to command and control each of the pucks 311 (each of which includes a wireless receiver configured to receive and act upon commands) to move to their respective positions, locations and/or orientations to hold the pieces of a truss 395 (or other structure to be assembled) while the truss pieces are being positioned and attached to one another using, e.g., a truss plate press and a plurality of truss plates (e.g., produced by punching light gauge galvanized steel to create teeth on one side for gripping the wood truss members). In some embodiments, each of the pucks 311 includes a microprocessor programmed to control the movement and locking actuators of its puck 311. In some embodiments, each of the pucks 311 includes a wireless transmitter to communicate status and/or location information back to puck-control microprocessor 415. In some embodiments, puck-control microprocessor 415 communicates to each of the camera-projector microprocessor 405 to receive image information from the cameras 401A-401D that is analyzed to determine locations of each of the pucks 311, and to transmit data to the camera-projector microprocessor 405 for the projectors 402A-402D. In some embodiments, when the puck 311 determines (in some embodiments, in response to a query from puck-control microprocessor 415) that the puck 311 needs to recharge itself, it notifies puck-control microprocessor 415, which then, once it is not immediately needed to remain in its current location, sends a command authorizing the puck to move to a recharging station 315, and the puck then moves itself to the respective recharging station 315.

In some embodiments, a processor system 405 (such as a Raspberry Pi® or the like) is connected to control operation of its respective camera 401 (such as 401A) and its respective projector 402 (such as 402A); and together, each set of an image-processor system 405, camera 401 and projector 402 of a projection subsystem 411, and a plurality of projection subsystems 411 together form a projection system 410 that simultaneously projects a set of slightly overlapping output images 404 (comprising, for example, output image 404A and output image 404B) that slightly overlap one another at their common edge regions as they land on truss-assembly table 409 and on the truss pieces that are being assembled thereon. In some embodiments, the input images 403 (e.g., 403A and 403B) obtained by the cameras 401 have fields of view that slightly overlap one another at their common edges. In some embodiments, the plurality of respective systems 411 are mounted to a support 407 and each performs at least some geometric compensation on the output images 404 based on images acquired during initial and ongoing calibration procedures.

In some embodiments, the plurality of respective image-processor systems 405 additionally or alternatively each have image-analysis software and/or hardware to automatically examine the input images 403 and perform image-analysis calculations (e.g., feature extraction that identifies and locates features such as table imperfections and tool slots on the table 409 that are used for geometric adjustments of the output images 404, and parts-identification and -location to verify that the correct parts are being used and that the parts (such as truss plates and two-by-four beams) are in the correct locations and are substantially defect-free).

Figure 5:
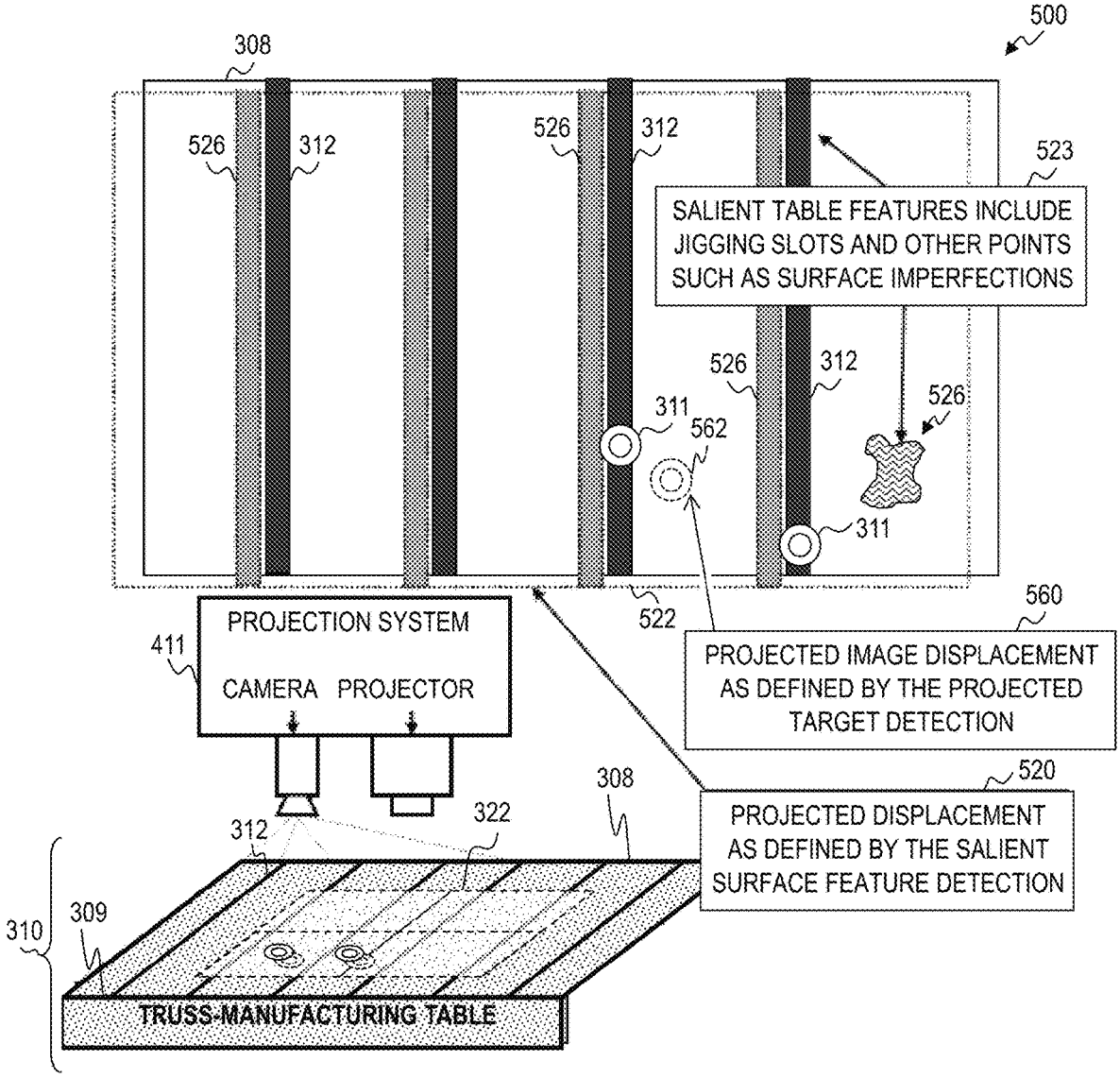
FIG. 5 is a perspective view block-diagram schematic of a system 500 having feature detection that identifies features that can be used to compensate for projector and table distortions and imperfections, according to some embodiments of the present invention.

FIG. 5 is a perspective view block-diagram schematic of a system 500 having feature detection that both locates pucks 311 and identifies features, such as slots 312 and marks 526, that can be used to compensate for projector and table distortions and imperfections, according to some embodiments of the present invention. In some embodiments, the automatic calibration adjustment, to adjust for deviations of the projected image in relation to the truss manufacturing surface TMS 209 (a rigid metal structure), at the time of calibration, and subsequently at regular time intervals (or as requested), obtains from each projector/camera system 411 a first image of the table surface (including table edges 308 and 309, slots 312, jigging pucks 311, and random or purposely made marks 526), and a second image of the table with projected special targets (fiducial indicators of the image) on the surface (the second image being of the same table area as the first image, but with the addition of the projected targets). In some embodiments, using a machine-vision algorithm for salient table-feature detection, a displacement of the projector/camera system 411 in relation to the table is calculated. (In some embodiments, process 520 calculates displacement relative to salient surface features by imaging the salient surface features such as 526 without the projected image and then projecting a calibration image (which, in some embodiments, includes projected markings), and then imaging the table again to measure the distance between the projected markings and the salient surface features 526; and process 560 calculates displacement between two features (e.g., 562 in the projected image and features such as jigging puck 311) of the table and things on the table.) Then, using the target-detection algorithm, an absolute displacement of each portion or segment in the projected image (including, e.g., a projected image of the projected table edge 308, projected slots 526, projected jigging pucks 562) in relation to each of the table surface features is obtained. Using this displacement map (i.e., the amount and direction of displacement for each area subdivision of the projected image), a new calibration matrix is calculated and the truss image is recreated and projected.

In some embodiments, each of the plurality of the pucks 311 include top-surface LEDs that are selectively driven with pulsed signals that are encoded with the puck serial number or other such data, such that the camera-projector system 411 can identify and locate each puck so that whether or not each puck is in the correct desired location can be determined.

Figure 6:
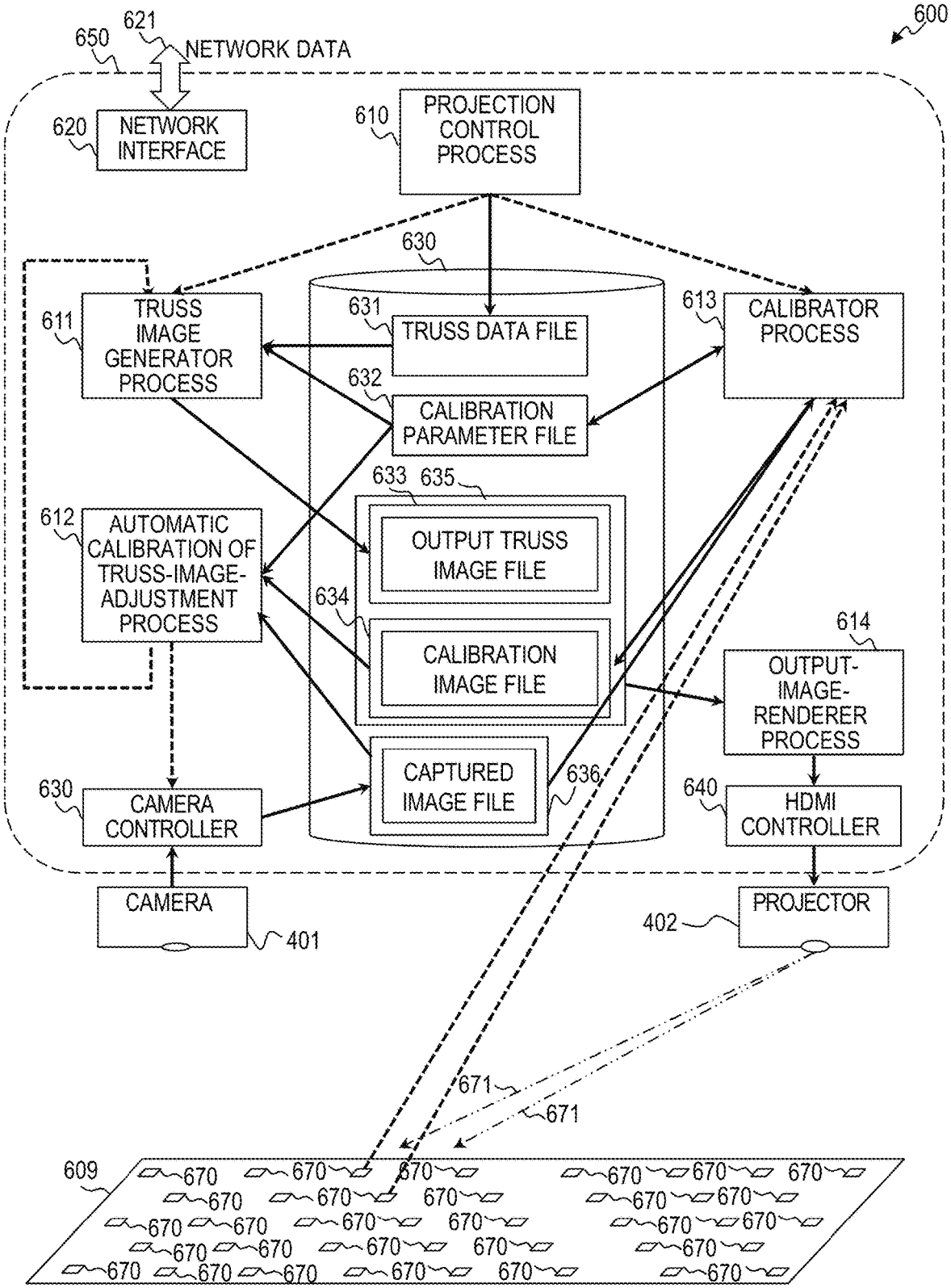
FIG. 6 is a block-diagram schematic of a software- and hardware-based projection system 600 used by projector-camera subsystems 411, according to some embodiments of the present invention.

FIG. 6 is a block-diagram schematic of a software- and hardware-based projection system 600 used by projector-camera subsystems 411, according to some embodiments of the present invention. In some embodiments, system 600 includes a software-implemented process 650.

In FIG. 6 dotted arrows represent control flow and solid arrows represent data flow. In some embodiments, the output image file 635 contains an output truss image 633 created by truss image generator process 611 (during normal operation), or calibration grid 634 created by calibrator process 613 (during calibration procedure). In some embodiments, an automatic calibration of truss-image-adjustment process 612 uses the calibration parameters obtained from calibration parameter file 632 and/or an image 636 or the analysis results obtained from a captured image 636 to adjust the locations of endpoints of each segment of the truss lines being generated by truss-image-generator process 611. In some embodiments, a first embodiment of the calibration process 613 uses the input image 636 of the truss-manufacturing system (TMS) table 609 and performs an image-analysis process to identify features in that input image that are used for the calibration, monitoring and feedback.

In some embodiments, a different second embodiment of calibration process 613 is used as a substitute for, or as an addition to, the first embodiment of the calibration process 613 in which the input images 636 from the cameras 401 are used to obtain images of the table 109 of TMS table 609, wherein the images are analyzed and used for calibration, monitoring and feedback. In some embodiments, the second embodiment of calibration process 613 uses light sensors 670 that are embedded in the table 609 at a plurality of spaced-apart locations, and each light sensor 670 communicates signals to calibration process 613. In some such embodiments, the projected calibration image 634 (e.g., having an array of pixels that can each be illuminated or turned off, for example an HD (high-definition) image of 1024-by-1920 pixels) is controlled to move each respective calibration point 671 of the projected image (pixel-to-pixel) until the exact pixel that should correspond to a particular respective sensor 670 has activated that sensor 670, and the signal from the particular sensor to calibration process 613 indicates that that exact pixel does correspond to the particular respective sensor 670.

In some embodiments of the first embodiment of the calibration process 613, reflectors are substituted for the sensors at each location on table 609 (the locations that would be used for sensors 670 in the second embodiment), and the camera 401 captures images that indicate when a particular pixel of projected light is detected to have been reflected by a particular reflector at the particular location 670.

In some embodiments, when the computer system, using the camera images of puck locations, is unable to get a particular puck to move to the correct desired position or to successfully lock itself in position, the system transmits a code to the puck to cause the puck to issue a fault indication (such as flashing lights, audio sirens or voice alerts, or other indication) for a human user to pull the failing puck from the jigging table and get a replacement puck that the system can command to move to the correct desired location and lock itself into place.

In some embodiments, the present invention provides a truss jig positioning system that includes: a table having a support plane on which work pieces are supported, wherein the table includes a plurality of segments, and wherein side edges of a first pair of adjacent segments of the plurality of segments define a first slot; a puck assembly automatically movable along the first slot, wherein the puck assembly is self-powered; and a controller configured to control the puck assembly. In some embodiments, the puck assembly is configured to be moved from the first slot to a second slot defined by side edges of a second pair of adjacent segments of the plurality of segments. In some embodiments, the puck assembly includes one or more sensors configured to provide location information to the controller. In some embodiments, the controller is located remotely from the puck assembly. Some embodiments further include a recharge station is located on an end of the first slot, wherein the puck assembly is powered by one or more rechargeable batteries, and wherein the puck assembly is configured to automatically move to the recharge station and make electrical contact with the recharge station in order to recharge the one or more rechargeable batteries when the one or more rechargeable batteries are in need of being recharged. Some embodiments further include a recharge station is located on an end of the first slot, wherein the puck assembly is powered by one or more supercapacitors, and wherein the puck assembly is configured to automatically move to the recharge station and make electrical contact with the recharge station in order to recharge the one or more supercapacitors when the one or more supercapacitors are in need of being recharged. Some embodiments further include a camera system that obtains images of the jigging table and its pucks, determines the identity and location of each puck, and then transmits location-correction information as needed to the various pucks to move them to desired locations for building one of a plurality of different truss shapes.

In some embodiments, the present invention provides a first truss-jig positioning system for use with a table having a support plane on which work pieces are supported, wherein the table includes a plurality of slots including a first slot and a second slot. The truss jig positioning system includes: a first puck assembly configured to receive one or more move commands and based on the one or more move commands, move itself to each selected one of a plurality of selectable locations along the first slot of the table, wherein the first puck assembly is self-powered.

In some embodiments of the first truss-jig positioning system, the first puck assembly is configured to be removed from the first slot and coupled to (i.e., the slot portion of the first puck assembly being inserted into) the second slot.

Some embodiments of the truss-jig positioning system further include: a first controller configured to control movement of the first puck assembly, wherein the first puck assembly includes one or more sensors configured to provide location information to the first controller.

Some embodiments of the first truss-jig positioning system further include: a first controller configured to control movement of the first puck assembly, wherein the first controller is located remote from the first puck assembly.

Some embodiments of the truss-jig positioning system further include: a recharge station configured to be located on an end of the first slot, wherein the first puck assembly is powered by one or more rechargeable batteries, and wherein the first puck assembly is configured to automatically move to the recharge station and make electrical contact with the recharge station in order to recharge the one or more rechargeable batteries when the one or more rechargeable batteries are in need of being recharged.

Some embodiments of the truss-jig positioning system further include: a recharge station configured to be located on an end of the first slot, wherein the first puck assembly is powered by one or more supercapacitors having a total capacitance of at least 0.1 farad, and wherein the first puck assembly is configured to automatically move to the recharge station and make electrical contact with the recharge station in order to recharge the one or more supercapacitors when the one or more rechargeable batteries are in need of being recharged.

Some embodiments of the first truss-jig positioning system further include: a machine-vision system that obtains images of the jigging table and its puck assemblies, determines the identity and location of each puck assembly, and then transmits location-correction information as needed to the various puck assemblies to move them to desired locations for building one of a plurality of different truss shapes.

Some embodiments of the truss-jig positioning system further include: the table, wherein the table is a truss-assembly table; a plurality of additional puck assemblies each equivalent to the first puck assembly; one or more respective recharge stations, each located relative to one or more of the plurality of slots such that one or more respective ones of the puck assemblies can move to a location at which the respective puck can receive electrical power from one or more of the respective recharge stations; a first controller configured to control movement of the first puck assembly and the plurality of additional puck assemblies, wherein the first puck assembly and each of the plurality of additional puck assemblies includes one or more features configured to provide location information to the first controller; and a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes.

Some embodiments of the first truss-jig positioning system further include: the table, wherein the table is a truss-assembly table; a plurality of additional puck assemblies each equivalent to the first puck assembly; one or more respective recharge stations, each located relative to one or more of the plurality of slots such that one or more respective ones of the puck assemblies can move to a location at which the respective puck can receive electrical power from one or more of the respective recharge stations; a first controller configured to control movement of the first puck assembly and the plurality of additional puck assemblies; a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes; and a projection system configured to project a human-perceptible light pattern to help a human user position pieces of wood on the table to be assembled into a truss.

Some embodiments of the first truss-jig positioning system further include: the table, wherein the table is a truss-assembly table; a plurality of additional puck assemblies each equivalent to the first puck assembly; one or more respective recharge stations, each located relative to one or more of the plurality of slots such that one or more respective ones of the puck assemblies can move to a location at which the respective puck can receive electrical power from one or more of the respective recharge stations; a first controller configured to control movement of the first puck assembly and the plurality of additional puck assemblies; a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes; and an automatic part-positioning system configured to obtain and position pieces of wood on the table to be assembled into a truss.

In some embodiments, the present invention provides a first truss truss-jig positioning method for use with a table having a support plane on which work pieces are supported, wherein the table includes a plurality of slots including a first slot and a second slot. The first truss jig positioning method includes: providing a first puck assembly, wherein the first puck assembly is self-powered; wirelessly transmitting one or more positioning commands to the first puck assembly; receiving the one or more move commands by the first puck assembly, and based on the one or more positioning commands, having the first puck assembly move itself to each selected one of a plurality of selectable locations along the first slot of the table.

Some embodiments of the first truss-jig positioning method further include: removing the first puck assembly from the first slot and coupling the first puck assembly to (i.e., inserting the slot portion of the first puck assembly into) the second slot.

Some embodiments of the first truss-jig positioning method further include: removing the first puck assembly from the first slot and coupling a second puck assembly to (i.e., inserting the slot portion of the first puck assembly into) the first slot.

Some embodiments of the first truss-jig positioning method further include: controlling movement of the first puck assembly from a remote first controller, wherein the first puck assembly includes one or more sensors configured to determine location information; and wirelessly communicating the location information from the first puck assemble to the first controller.

Some embodiments of the first truss-jig positioning method further include: obtaining image information into a first controller remote from the first puck assembly; and controlling movement of the first puck assembly from the remote first controller based on the image information.

Some embodiments of the first truss-jig positioning method further include: positioning a recharge station on an end of the first slot; powering the first puck assembly from one or more rechargeable batteries, and wherein the puck assembly is configured to automatically move to the recharge station and make electrical contact with the recharge station in order to recharge the one or more rechargeable batteries when the one or more rechargeable batteries are in need of being recharged.

Some embodiments of the first truss-jig positioning method further include: locating a recharge station on an end of the first slot; powering the first puck assembly from one or more supercapacitors having a total capacitance of at least 0.1 farad, and wherein the puck assembly is configured to automatically move to the recharge station and make electrical contact with the recharge station in order to recharge the one or more supercapacitors when the one or more supercapacitors are in need of being recharged.

Some embodiments of the first truss-jig positioning method further include: positioning a recharge station on an end of the first slot; powering the first puck assembly from one or more supercapacitors having a total capacitance of at least 0.1 farad, and wherein the puck assembly is configured to automatically move to the recharge station and wirelessly receiving power from the recharge station in order to recharge the one or more supercapacitors when the one or more supercapacitors are in need of being recharged. Some such embodiments improve reliability over similar embodiments that make electrical contact with the recharge station that are susceptible to failure due to dust, corrosion and/or contaminants of a factory environment.

Some embodiments of the first truss-jig positioning method further include: obtaining images of the jigging table and its pucks by a machine-vision system; determining an identity and location of each puck, and then transmits location-correction information as needed to the various pucks to move them to desired locations for building one of a plurality of different truss shapes.

Some embodiments of the first truss-jig positioning method further include: providing a plurality of additional puck assemblies each equivalent to the first puck assembly; positioning one or more respective recharge stations relative to one or more of the plurality of slots such that one or more of the pucks can move to a location at which the puck can receive electrical power from one or more of the respective recharge stations; controlling movement of the first puck assembly and the plurality of additional puck assemblies by a first controller; obtaining images of the jigging table and its puck assemblies by a machine-vision system coupled to the first controller; determining, by the first controller, an identity and location of each respective puck assembly; transmitting location-correction information from the first controller to a respective one of the puck assemblies to move the respective puck assembly to a respective one of selected desired locations for building one of a plurality of different truss shapes.

Some embodiments of the first truss-jig positioning method further include: providing a plurality of additional puck assemblies each equivalent to the first puck assembly; positioning one or more respective recharge stations relative to one or more of the plurality of slots such that one or more of the pucks can move to a location at which the puck can receive electrical power from one or more of the respective recharge stations; controlling movement of the first puck assembly and the plurality of additional puck assemblies by a first controller; determining, by the first controller, an identity and location of each respective puck assembly; transmitting location-correction information from the first controller to a respective one of the puck assemblies to move the respective puck assembly to a respective one of selected desired locations for building one of a plurality of different truss shapes; and projecting a human-perceptible light pattern under control of the first controller to assist a human user position pieces of wood on the table to be assembled into a truss. In some such embodiments, the first puck assembly and each of the plurality of additional puck assemblies includes one or more features configured to provide location information to the first controller.

Some embodiments of the first truss-jig positioning method further include: providing a plurality of additional puck assemblies each equivalent to the first puck assembly; positioning one or more respective recharge stations relative to one or more of the plurality of slots such that one or more of the pucks can move to a location at which the puck can receive electrical power from one or more of the respective recharge stations; controlling movement of the first puck assembly and the plurality of additional puck assemblies by a first controller; obtaining images of the jigging table and its puck assemblies; determining by the first controller an identity and location of each respective puck assembly; transmitting location-correction information as needed to a respective puck assembly to control movement of the respective puck assembly to a respective one of selected desired locations for building one of a plurality of different truss shapes; and obtaining and positioning pieces of wood on the table to be assembled into a truss by an automatic part-positioning system. In some such embodiments, the first puck assembly and each of the plurality of additional puck assemblies includes one or more features configured to provide location information to the first controller.

In some embodiments, the present invention provides a second jigging puck system for use with a jigging table that includes a plurality of slots. The second jigging puck system includes: a first puck assembly that includes: a power source, a drive mechanism configured to move the first puck assembly along at least one of the plurality of slots, a first motor coupled to receive power from the power source and configured to power the drive mechanism, a communications module configured to wirelessly communicate signals, and a microprocessor coupled to the communications module and configured to control movement of the first puck assembly based at least in part on the communicated signals.

Some embodiments of the second jigging puck system further include: the jigging table.

Some embodiments of the second jigging puck system further include: the jigging table, wherein the first puck assembly further includes a locking system coupled to the microprocessor and configured to lock the first puck assembly in a desired position in the at least one of the plurality of slots.

In some embodiments of the second jigging puck system, the drive mechanism includes a plurality of elastomeric drive wheels.

In some embodiments of the second jigging puck system, the power source includes a battery.

In some embodiments of the second jigging puck system, the power source includes a battery, and wherein the first puck assembly further includes a plurality of electrical contacts electrically coupled to the battery and configured to electrically connect to a recharging station in order to recharge the battery.

In some embodiments of the second jigging puck system, the power source includes a battery, and wherein the first puck assembly further includes an electromagnetic device coupled to the battery and configured to charge the battery via a recharging station without electrically contacting the recharging station.

In some embodiments of the second jigging puck system, the first puck assembly is one of a plurality of substantially similar puck assemblies including the first puck assembly, a second puck assembly, and a third puck assembly, and wherein each one of the plurality of puck assemblies is configured to move independently from others of the plurality of puck assemblies.

In some embodiments of the second jigging puck system, the first puck assembly has a shape, and wherein the shape is an elongated rectangular prism with rounded ends.

In some embodiments of the second jigging puck system, the power source includes a battery, and the second jigging puck system further includes: the jigging table; and one or more recharging stations coupled to the table and configured to recharge the battery.

Some embodiments of the second jigging puck system further include: the jigging table, wherein the first puck assembly is one of a plurality of identical puck assemblies including the first puck assembly, a second puck assembly, and a third puck assembly, wherein each one of the plurality of puck assemblies is configured to fit into and move along at least one of the plurality of slots, and wherein each respective one of the plurality of puck assemblies further includes a locking system coupled to the microprocessor and configured to lock the respective puck assembly in a desired position in the at least one of the plurality of slots; one or more image-processor devices configured to obtain input images of the jigging table and the plurality of puck assemblies, and to project output images onto the jigging table in order to guide assembly of a truss on the jigging table; and a system microprocessor operatively coupled to the plurality of image-processor devices and configured to wirelessly communicate with the plurality of puck assemblies in order to control movement of the plurality of puck assemblies such that the plurality of puck assemblies are positioned on the jigging table to hold pieces of the truss in place during the assembly of the truss. In some such embodiments, each one of the plurality of image-processor devices includes a camera and a projector.

In some embodiments of the second jigging puck system, each one of the plurality of image-processor devices is configured to perform image-analysis calculations on the input images to verify that parts of the truss are placed in correct locations on the jigging table.

In some embodiments of the second jigging puck system, the plurality of image-processor devices is configured to calculate a displacement of the plurality of image-processor devices in relation to the jigging table.

In some embodiments of the second jigging puck system, the first puck assembly includes one or more sensors configured to provide location information to the first puck assembly.

Some embodiments of the second jigging puck system further include: a jigging table that includes a plurality of slots, wherein the first puck assembly is configured to fit into and move along at least one of the plurality of slots; wherein the first puck assembly further includes a locking system coupled to the microprocessor and configured to lock the first puck assembly in a desired position in the at least one of the plurality of slots, and wherein the locking system includes a brake mechanism that provides contralateral pressure on sides of the at least one of the plurality of slots that contains the first puck assembly.

In some embodiments of the second jigging puck system, the power source includes a supercapacitor.

In some embodiments of the second jigging puck system, the power source includes a supercapacitor, and the jigging puck system further includes: the jigging table; and one or more recharging stations coupled to the table and configured to recharge the supercapacitor.

Some embodiments of the second jigging puck system further include: the table, wherein the table is a truss-assembly table; a plurality of additional puck assemblies each equivalent to the first puck assembly; one or more respective recharge stations, each located relative to one or more of the plurality of slots such that one or more respective ones of the puck assemblies can move to a location at which the respective puck can receive electrical power from one or more of the respective recharge stations; a first controller configured to control movement of the first puck assembly and the plurality of additional puck assemblies; a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes; and a projection system configured to project a human-perceptible light pattern to help a human user position pieces of wood on the table to be assembled into a truss.

Some embodiments of the second jigging puck system further include: the table, wherein the table is a truss-assembly table; a plurality of additional puck assemblies each equivalent to the first puck assembly; one or more respective recharge stations, each located relative to one or more of the plurality of slots such that one or more respective ones of the puck assemblies can move to a location at which the respective puck can receive electrical power from one or more of the respective recharge stations; a first controller configured to control movement of the first puck assembly and the plurality of additional puck assemblies; a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes; and an automatic part-positioning system configured to obtain and position pieces of wood on the table to be assembled into a truss.

In some embodiments, the present invention provides a third truss jigging puck system for use with a jigging table that includes a plurality of slots. The third truss jigging puck system includes: a first puck assembly, wherein the first puck assembly is self-powered; means for wirelessly transmitting one or more positioning commands to the first puck assembly; and means for receiving the one or more move commands by the first puck assembly, and based on the one or more positioning commands, having the first puck assembly move itself to each selected one of a plurality of selectable locations along the first slot of the table.

Some embodiments of the third truss jigging puck system further include: the jigging table.

Some embodiments of the third truss jigging puck system further include: means for removing the first puck assembly from the first slot and for coupling the first puck assembly to the second slot.

Some embodiments of the third truss jigging puck system further include: means for controlling movement of the first puck assembly from a remote first controller, wherein the first puck assembly includes one or more sensors configured to determine location information; and means for wirelessly communicating the location information from the first puck assemble to the first controller.

Some embodiments of the third truss jigging puck system further include: means for obtaining image information into a first controller remote from the first puck assembly; and means for controlling movement of the first puck assembly from the remote first controller based on the image information.

In some embodiments of the third truss jigging puck system, a recharge station is positioned on an end of the first slot, and the third system further includes: rechargeable battery means for powering the first puck assembly, wherein the puck assembly is configured to automatically move to the recharge station and make electrical contact with the recharge station in order to recharge the rechargeable battery means when the rechargeable battery means are in need of being recharged.

In some embodiments of the third truss jigging puck system, a recharge station is positioned on an end of the first slot, and the third system further includes: one or more supercapacitors having a total capacitance of at least 0.1 farad, and wherein the puck assembly includes means for automatically moving to the recharge station and for making electrical contact with the recharge station in order to recharge the one or more supercapacitors when the one or more supercapacitors are in need of being recharged.

Some embodiments of the third truss jigging puck system further include: means for obtaining images of the jigging table and its pucks by a machine-vision system; and means for determining an identity and location of each puck, and then for transmitting location-correction information as needed to the various pucks to move them to desired locations for building one of a plurality of different truss shapes.

Some embodiments of the third truss jigging puck system further include: a plurality of additional puck assemblies each equivalent to the first puck assembly; means for positioning one or more respective recharge stations relative to one or more of the plurality of slots such that one or more of the pucks can move to a location at which the puck can receive electrical power from one or more of the respective recharge stations; means for controlling movement of the first puck assembly and the plurality of additional puck assemblies by a first controller; means for obtaining images of the jigging table and its puck assemblies by a machine-vision system coupled to the first controller; means for determining, by the first controller, an identity and location of each respective puck assembly; and means for transmitting location-correction information from the first controller to a respective one of the puck assemblies to move the respective puck assembly to a respective one of selected desired locations for building one of a plurality of different truss shapes.

Some embodiments of the third truss jigging puck system further include: a plurality of additional puck assemblies each equivalent to the first puck assembly; means for positioning one or more respective recharge stations relative to one or more of the plurality of slots such that one or more of the pucks can move to a location at which the puck can receive electrical power from one or more of the respective recharge stations; means for controlling movement of the first puck assembly and the plurality of additional puck assemblies by a first controller; wherein the first puck assembly and each of the plurality of additional puck assemblies includes one or more features configured to provide location information to the first controller; means for determining, by the first controller, an identity and location of each respective puck assembly; means for transmitting location-correction information from the first controller to a respective one of the puck assemblies to move the respective puck assembly to a respective one of selected desired locations for building one of a plurality of different truss shapes; and means for projecting a human-perceptible light pattern under control of the first controller to assist a human user position pieces of wood on the table to be assembled into a truss.

Some embodiments of the third truss jigging puck system further include: a plurality of additional puck assemblies each equivalent to the first puck assembly; means for positioning one or more respective recharge stations relative to one or more of the plurality of slots such that one or more of the pucks can move to a location at which the puck can receive electrical power from one or more of the respective recharge stations; means for controlling movement of the first puck assembly and the plurality of additional puck assemblies by a first controller; wherein the first puck assembly and each of the plurality of additional puck assemblies includes one or more features configured to provide location information to the first controller; means for obtaining images of the jigging table and its puck assemblies; means for determining by the first controller an identity and location of each respective puck assembly; means for transmitting location-correction information as needed to a respective puck assembly to control movement of the respective puck assembly to a respective one of selected desired locations for building one of a plurality of different truss shapes; and means for obtaining and positioning pieces of wood on the table to be assembled into a truss by an automatic part-positioning system.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should be, therefore, determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

What is claimed is:

1. A truss jig positioning system for use with a table having a support plane on which work pieces are supported, wherein the table includes a plurality of slots including a first slot and a second slot; the truss jig positioning system comprising:

a first puck assembly that includes a first motor in the first puck assembly and an on-board electrical power source operatively coupled to the first motor, wherein the first puck assembly is configured to receive one or more move commands and based on the one or more move commands, move itself via the first motor to each selected one of a plurality of selectable locations along the first slot of the table, wherein the first puck assembly is self-powered by the on-board electrical power source.

2. The truss jig positioning system of claim 1, wherein the first puck assembly is configured to be removed from the first slot and coupled to the second slot.

3. The truss jig positioning system of claim 1, further comprising:

a recharge station configured to be located on an end of the first slot, wherein the first puck assembly is powered by one or more supercapacitors having a total capacitance of at least 0.1 farad, and wherein the first puck assembly is configured to automatically move to the recharge station and make electrical contact with the recharge station in order to recharge the one or more supercapacitors when the one or more rechargeable batteries are in need of being recharged.

4. The truss jig positioning system of claim 1, further comprising:

a machine-vision system that obtains images of the jigging table and its puck assemblies, determines the identity and location of each puck assembly, and then transmits location-correction information as needed to the various puck assemblies to move them to desired locations for building one of a plurality of different truss shapes.

5. The truss jig positioning system of claim 1, further comprising:

the table, wherein the table is a truss-assembly table;

a plurality of additional puck assemblies each equivalent to the first puck assembly;

one or more respective recharge stations, each located relative to one or more of the plurality of slots such that one or more respective ones of the puck assemblies can move to a location at which the respective puck can receive electrical power from one or more of the respective recharge stations;

a first controller configured to control movement of the first puck assembly and the plurality of additional puck assemblies, wherein the first puck assembly and each of the plurality of additional puck assemblies includes one or more features configured to provide location information to the first controller; and a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes.

6. The truss jig positioning system of claim 1, further comprising:

the table, wherein the table is a truss-assembly table;

a plurality of additional puck assemblies each equivalent to the first puck assembly;

one or more respective recharge stations each located relative to one or more of the plurality of slots such that one or more respective ones of the puck assemblies can move to a location at which the respective puck can receive electrical power from one or more of the respective recharge stations;

a first controller configured to control movement of the first puck assembly and the plurality of additional puck assemblies;

a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes; and a projection system configured to project a human-perceptible light pattern to help position pieces of wood on the table to be assembled into a truss.

7. The truss jig positioning system of claim 1, further comprising:

the table, wherein the table is a truss-assembly table;

a plurality of additional puck assemblies each equivalent to the first puck assembly;

one or more respective recharge stations, each located relative to one or more of the plurality of slots such that one or more respective ones of the puck assemblies can move to a location at which the respective puck can receive electrical power from one or more of the respective recharge stations;

a first controller configured to control movement of the first puck assembly and the plurality of additional puck assemblies;

a machine-vision system that obtains images of the jigging table and its puck assemblies, determines an identity and location of each respective puck assembly, and then transmits location-correction information as needed to the respective puck assembly to move the respective puck assembly to a respective one of selected desired locations for building one of a plurality of different truss shapes; and an automatic part-positioning system configured to obtain and position pieces of wood on the table to be assembled into a truss.

8. A truss jig positioning system for use with a table having a support plane on which work pieces are supported, wherein the table includes a plurality of slots including a first slot and a second slot; the truss jig positioning system comprising:

a first puck assembly configured to receive one or more move commands and based on the one or more move commands, move itself to each selected one of a plurality of selectable locations along the first slot of the table, wherein the first puck assembly is self-powered; and a recharge station configured to be located on an end of the first slot, wherein the first puck assembly is powered by one or more rechargeable batteries, and wherein the first puck assembly is configured to automatically move to the recharge station and make electrical contact with the recharge station in order to recharge the one or more rechargeable batteries when the one or more rechargeable batteries are in need of being recharged.

9. A truss jig positioning method for use with a table having a support plane on which work pieces are supported, wherein the table includes a plurality of slots including a first slot and a second slot; the truss jig positioning method comprising:

providing a first puck assembly that includes a first motor in the first puck assembly and an on-board electrical power source operatively coupled to the first motor, wherein the first puck assembly is self-powered by the on-board electrical power source; wirelessly transmitting one or more positioning commands to the first puck assembly; and receiving the one or more positioning commands by the first puck assembly, and based on the one or more positioning commands, having the first puck assembly move itself via the first motor to each selected one of a plurality of selectable locations along the first slot of the table.

10. The truss jig positioning method of claim 9, further comprising:

removing the first puck assembly from the first slot and coupling the first puck assembly to the second slot.

11. The truss jig positioning method of claim 9, further comprising:

obtaining image information into a first controller remote from the first puck assembly; and controlling movement of the first puck assembly from the remote first controller based on the image information.

12. The truss jig positioning method of claim 9, further comprising:

positioning a recharge station on an end of the first slot; and powering the first puck assembly from one or more supercapacitors having a total capacitance of at least 0.1 farad, and wherein the puck assembly is configured to automatically move to the recharge station and make electrical contact with the recharge station in order to recharge the one or more supercapacitors when the one or more supercapacitors are in need of being recharged.

13. The truss jig positioning method of claim 9, further comprising:

obtaining images of the jigging table and its pucks by a machine-vision system; and determining an identity and location of each puck, and then transmitting location-correction information as needed to the various pucks to move them to desired locations for building one of a plurality of different truss shapes.

14. The truss jig positioning method of claim 9, further comprising:

providing a plurality of additional puck assemblies each equivalent to the first puck assembly;

positioning one or more respective recharge stations relative to one or more of the plurality of slots such that one or more of the pucks can move to a location at which the puck can receive electrical power from one or more of the respective recharge stations;

controlling movement of the first puck assembly and the plurality of additional puck assemblies by a first controller;

obtaining images of the jigging table and its puck assemblies by a machine-vision system coupled to the first controller;

determining, by the first controller, an identity and location of each respective puck assembly; and transmitting location-correction information from the first controller to a respective one of the puck assemblies to move the respective puck assembly to a respective one of selected desired locations for building one of a plurality of different truss shapes.

15. The truss jig positioning method of claim 9, further comprising:

providing a plurality of additional puck assemblies each equivalent to the first puck assembly;

positioning one or more respective recharge stations relative to one or more of the plurality of slots such that one or more of the pucks can move to a location at which the puck can receive electrical power from one or more of the respective recharge stations;

controlling movement of the first puck assembly and the plurality of additional puck assemblies by a first controller; wherein the first puck assembly and each of the plurality of additional puck assemblies includes one or more features configured to provide location information to the first controller;

determining, by the first controller, an identity and location of each respective puck assembly;

transmitting location-correction information from the first controller to a respective one of the puck assemblies to move the respective puck assembly to a respective one of selected desired locations for building one of a plurality of different truss shapes; and projecting a human-perceptible light pattern under control of the first controller to assist in positioning pieces of wood on the table to be assembled into a truss.

16. The truss jig positioning system of claim 1, wherein the first puck assembly includes:

a communications module configured to wirelessly receive the one or more move commands, and a microprocessor coupled to the communications module and configured to control movement of the first puck assembly based at least in part on the wirelessly received one or more move commands.

17. The truss jig positioning system of claim 16, further comprising:

the jigging table, wherein the first puck assembly further includes a locking system coupled to the microprocessor and configured to lock the first puck assembly in a desired position in the at least one of the plurality of slots.

18. The truss jig positioning system of claim 16, wherein the first puck assembly further includes a plurality of elastomeric drive wheels.

19. The truss jig positioning system of claim 16, wherein the first puck assembly is one of a plurality of substantially similar puck assemblies including the first puck assembly, a second puck assembly, and a third puck assembly, and wherein each one of the plurality of puck assemblies is configured to move independently from others of the plurality of puck assemblies.

20. A truss jig positioning system comprising:

a first puck assembly;

means for moving the first puck assembly, wherein the means for moving is located in the first puck assembly;

means for electrically powering the means for moving, wherein the means for electrically powering is on board the first puck assembly;

means for wirelessly transmitting one or more positioning commands to the first puck assembly; and means for receiving the one or more positioning commands at the first puck assembly, and based on the one or more positioning commands, causing the first puck assembly to move itself to each selected one of a plurality of selectable locations along the first slot of the table.

* * * * *